US010358879B2

(12) United States Patent
Maurer et al.

(10) Patent No.: US 10,358,879 B2
(45) Date of Patent: Jul. 23, 2019

(54) PIVOTING ROD BOX FOR A HORIZONTAL DIRECTIONAL DRILLING MACHINE

(71) Applicant: Vermeer Manufacturing Company, Pella, IA (US)

(72) Inventors: Brandon A. Maurer, Pella, IA (US); Ward E. Ryon, St. Joseph, MO (US); Clint Recker, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 367 days.

(21) Appl. No.: 15/386,682

(22) Filed: Dec. 21, 2016

(65) Prior Publication Data

US 2017/0175461 A1 Jun. 22, 2017

Related U.S. Application Data

(60) Provisional application No. 62/271,053, filed on Dec. 22, 2015.

(51) Int. Cl.

| | |
|---|---|
| ***E21B 19/14*** | (2006.01) |
| ***E21B 7/02*** | (2006.01) |
| ***E21B 3/02*** | (2006.01) |
| ***E21B 7/04*** | (2006.01) |
| ***E21B 19/083*** | (2006.01) |
| ***E21B 19/15*** | (2006.01) |

(52) U.S. Cl.

CPC ..... *E21B 19/14* (2013.01); *E21B 3/02* (2013.01); *E21B 7/02* (2013.01); *E21B 7/025* (2013.01); *E21B 7/046* (2013.01); *E21B 19/083* (2013.01); *E21B 19/15* (2013.01)

(58) Field of Classification Search

CPC . E21B 7/02; E21B 7/025; E21B 19/14; E21B 19/15

USPC ..... 414/22.62, 745.4, 745.5, 745.6

See application file for complete search history.

(56) References Cited

U.S. PATENT DOCUMENTS

| | | | |
|---|---|---|---|
| 2,679,678 | A | 6/1954 | Stephan |
| 3,664,439 | A | 5/1972 | Council |
| 4,235,566 | A | 11/1980 | Beeman |
| 5,174,389 | A | 12/1992 | Hansen |

(Continued)

FOREIGN PATENT DOCUMENTS

| | | | |
|---|---|---|---|
| CN | 201225101 | Y | 4/2009 |
| CN | 202300247 | U | 7/2012 |
| WO | 2014105050 | A1 | 7/2014 |

*Primary Examiner* — D. Andrews
*Assistant Examiner* — Tara E Schmipf
(74) *Attorney, Agent, or Firm* — Merchant & Gould P.C.

(57) ABSTRACT

A horizontal directional drilling (HDD) machine that includes a rod box that has a large capacity, which allows the HDD machine to operate continuously for longer periods of time. The rod box has an upper end and a lower end and is pivotally connected to a frame of the HDD machine at a pivot axis positioned adjacent the lower end of the rod box. The rod box is pivotally movable between a stowed position and an operational position. The rod box obstructs movement of a drill head of the HDD machine when in the stowed position and is laterally offset from the drill head when in the operational position so as to not interfere with movement of the drill head. The rod box is tapered such that a width is larger adjacent the upper end of the rod box as compared to the lower end of the rod box.

18 Claims, 21 Drawing Sheets

(56) References Cited

U.S. PATENT DOCUMENTS

| | | | | |
|---|---|---|---|---|
| 5,259,723 | A | 11/1993 | Willis et al. | |
| 5,575,344 | A | 11/1996 | Wireman | |
| 6,074,153 | A * | 6/2000 | Allen | E21B 7/046 175/85 |
| 6,283,702 | B1 | 9/2001 | Devlugt et al. | |
| 6,408,954 | B1 | 6/2002 | Price et al. | |
| 6,474,931 | B1 | 11/2002 | Austin et al. | |
| 6,543,551 | B1 | 4/2003 | Sparks et al. | |
| 6,591,921 | B2 * | 7/2003 | Jenne | E21B 7/046 175/203 |
| 6,857,483 | B1 | 2/2005 | Dirks et al. | |
| 6,926,488 | B1 | 8/2005 | Bolding et al. | |
| 6,969,222 | B1 | 11/2005 | Koch | |
| 7,090,035 | B2 | 8/2006 | Lesko | |
| 7,467,670 | B2 | 12/2008 | Hartke et al. | |
| 7,537,424 | B2 * | 5/2009 | Innes | E21B 7/02 211/70.4 |
| 7,600,584 | B2 * | 10/2009 | Sewell | E21B 19/15 166/85.1 |
| 7,631,704 | B2 | 12/2009 | Hagemeyer et al. | |
| 7,694,751 | B2 | 4/2010 | Hartke | |
| 8,061,436 | B2 | 11/2011 | Zannini et al. | |
| 8,215,888 | B2 | 7/2012 | Tetley et al. | |
| 8,562,269 | B2 | 10/2013 | Hermes et al. | |
| 8,696,289 | B2 | 4/2014 | Tetley et al. | |
| 8,905,160 | B1 | 12/2014 | Verzilli et al. | |
| 9,121,236 | B2 | 9/2015 | Matlewski et al. | |
| 2005/0123356 | A1 * | 6/2005 | Wilkinson | F16L 1/10 405/184.5 |
| 2011/0091304 | A1 * | 4/2011 | Tetley | E21B 19/15 414/22.62 |
| 2011/0232971 | A1 | 9/2011 | Harmon | |
| 2013/0062126 | A1 | 3/2013 | Thorne | |
| 2014/0144707 | A1 | 5/2014 | Hartke et al. | |

* cited by examiner

PIVOTING ROD BOX FOR A HORIZONTAL DIRECTIONAL DRILLING MACHINE

CROSS REFERENCE TO RELATED APPLICATION

This application claims the benefit of U.S. Provisional Patent Application Ser. No. 62/271,053, filed Dec. 22, 2015, which application is hereby incorporated by reference in its entirety.

BACKGROUND

Utility lines for water, electricity, gas, telephone, and cable television are often run underground for reasons of safety and aesthetics. Horizontal directional drilling (HDD) is often used for placement of such utility lines. In a typical horizontal directional drilling sequence, the horizontal directional drilling machine drills a hole into the ground at an oblique angle and then drives a series of interconnected drill rods (i.e., a drill string) along a substantially horizontal path to create a horizontal hole. It is common to attach a utility line or other conduit to the drill string so that it is dragged back through the hole.

A typical horizontal directional drilling machine includes a frame on which is mounted a drive mechanism that can be slidably moved along the longitudinal axis of the frame. The drive mechanism is adapted to rotate the drill string about its longitudinal axis. Sliding movement of the drive mechanism along the frame, in concert with the rotation of the drill string, causes the drill string to be longitudinally advanced into or withdrawn from the ground.

A horizontal directional drilling machine also includes a rod box (i.e., a rack or magazine) for storing rods (i.e., pipes or other elongated members) used to make the drill strings. The more drill rods that are stored on the horizontal directional drilling machine, the longer the horizontal directional drilling machine can operate continuously. Further, storing drill rods on the horizontal directional drilling machine makes transportation and operation of the machine more efficient.

However, horizontal directional drilling machines are constrained by certain size requirements, and, therefore, the size of the rod box on the horizontal directional drilling machine is also constrained to certain size requirements. For example, the height of the horizontal directional drilling machine can be limited based on the location of the machine's center of gravity so as to prevent instability of the machine. Further, the width of the rod box, and the horizontal directional drilling machine in general, is also important as the horizontal directional drilling machine will need to be moved (i.e., driven) to the worksite from a trailer. Therefore, the ability to fit through certain narrow openings, such as gates, is important to the usefulness of the horizontal directional drilling machine.

Therefore, improvements are needed to increase or at least maintain (e.g., relative to a standard rod box) the capacity of rod boxes while also maintaining certain horizontal directional drilling machine dimensions.

SUMMARY

The present disclosure relates generally to a pivotable rod box for a horizontal directional drilling (HDD) machine. In one possible configuration, and by non-limiting example, the rod box is pivotable between a stowed position and an operational position, where the stowed position decreases the overall width of the HDD machine.

In a first aspect of the present disclosure, an HDD machine for drilling a string of drill rods into the ground is disclosed. The HDD machine includes a frame that supports a drill head track that defines a longitudinal axis. The HDD machine also includes a drill head mounted on the track, and the drill head includes a rotational rod drive. The HDD machine includes a thrust mechanism for moving the drill head along the longitudinal axis of the drill head track between a retracted position adjacent a first end of the drill head track and an extended position adjacent an opposite second end of the track. The HDD machine also includes a rod box for holding a plurality of drill rods. The rod box has an upper end and a lower end and is pivotally connected to the frame at a pivot axis positioned adjacent the lower end of the rod box. The pivot axis is oriented to extend along the longitudinal axis of the track, and the rod box is pivotally movable about the pivot axis between a stowed position and an operational position. The rod box overhangs the longitudinal axis of the drill head track and obstructs movement of the drill head from the retracted position to the extended position when in the stowed position. The rod box is laterally offset from a region above the longitudinal axis drill head track when in the operational position so as to not interfere with movement of the drill head along the longitudinal axis. The rod box has a load/unload opening adjacent the upper end of the rod box for allowing the drill rods to be manually loaded into the rod box and manually removed from the rod box. The rod box also includes a first side that faces toward the drill head track and a second side that faces away from the track. The load/unload opening of the rod box is positioned adjacent the first side and the rod box defines a width that extends between the first and second sides. The rod box is also tapered such that the width is larger adjacent the upper end of the rod box as compared to the lower end of the rod box. The rod box can accommodate more drill rods across the width adjacent the upper end as compared to adjacent the lower end.

In a second aspect of the present disclosure, an HDD machine for drilling a string of drill rods into the ground is disclosed. The HDD machine includes a frame that supports a drill head track that defines a longitudinal axis, the longitudinal axis residing in a vertical reference plane generally perpendicular to the ground. The HDD machine also includes a drill head mounted on the track, and the drill head includes a rotational rod drive. The HDD machine further includes a thrust mechanism for moving the drill head along the longitudinal axis of the drill head track between a retracted position adjacent a first end of the drill head track and an extended position adjacent an opposite second end of the track. The HDD machine includes a rod box for holding a plurality of drill rods. The rod box has a generally triangular shaped cross-section and a longitudinal axis generally parallel to the longitudinal axis of the frame. The rod box is pivotally connected to the frame and movable between a stowed position and an operational position. When in the operational position, drill rods can be loaded into the rod box and removed from the rod box during a drilling operation. When in the operational position, the furthest portion of the rod box from the vertical reference plane is located at a distance D1 therefrom, and when in the stowed position, the furthest portion of the rod box from the vertical reference plane is located at a distance D2 therefrom. The distance D1 is greater than the distance D2.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
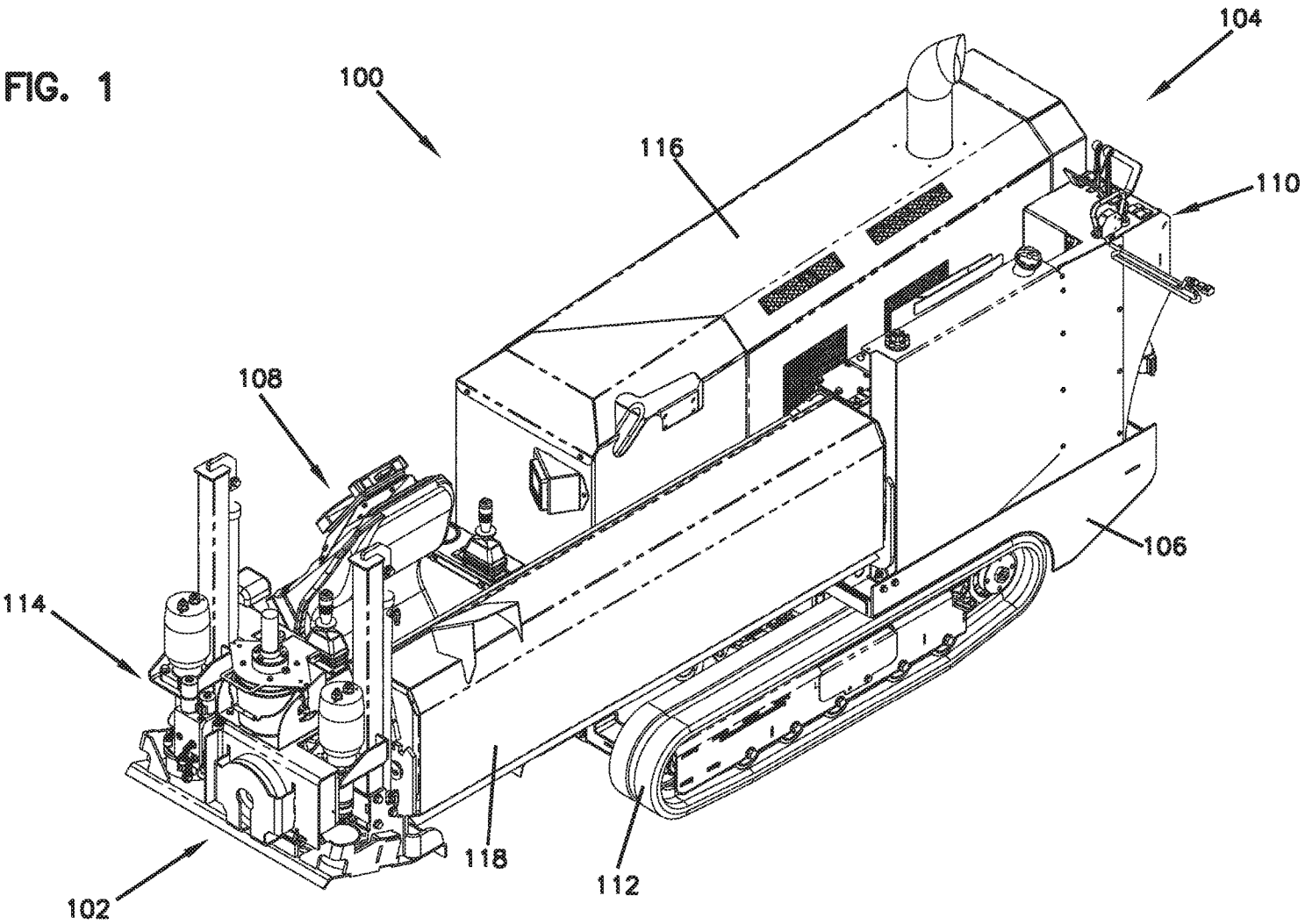
FIG. 1 illustrates a perspective view of an HDD machine in an inactive position, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The HDD machine disclosed herein has several advantages. Specifically, the rod box of the present disclosure is pivotally connected to the HDD machine, allowing the rod box to move from a stowed position to an operational position. When in the stowed position, the rod box allows the HDD machine to maintain a narrow width (e.g., narrow enough to pass through a yard gate (typically about 36 or 42 inches wide)), while still storing a substantial amount of drill rods on the HDD machine. When moving from the stowed position to the operational position, the rod box pivots away from the HDD machine so as to allow full operation of the HDD machine. More generally, the pivoting rod box of the present disclosure allows the other components of the HDD machine to be increased in size (i.e., the engine) while still maintaining sufficient drill rod storage and size requirements for the HDD machine. Furthermore, the present HDD machine provides a lower center of gravity, both in the operational and stowed positions, thereby minimizing the tendency for instability.

Figure 2:
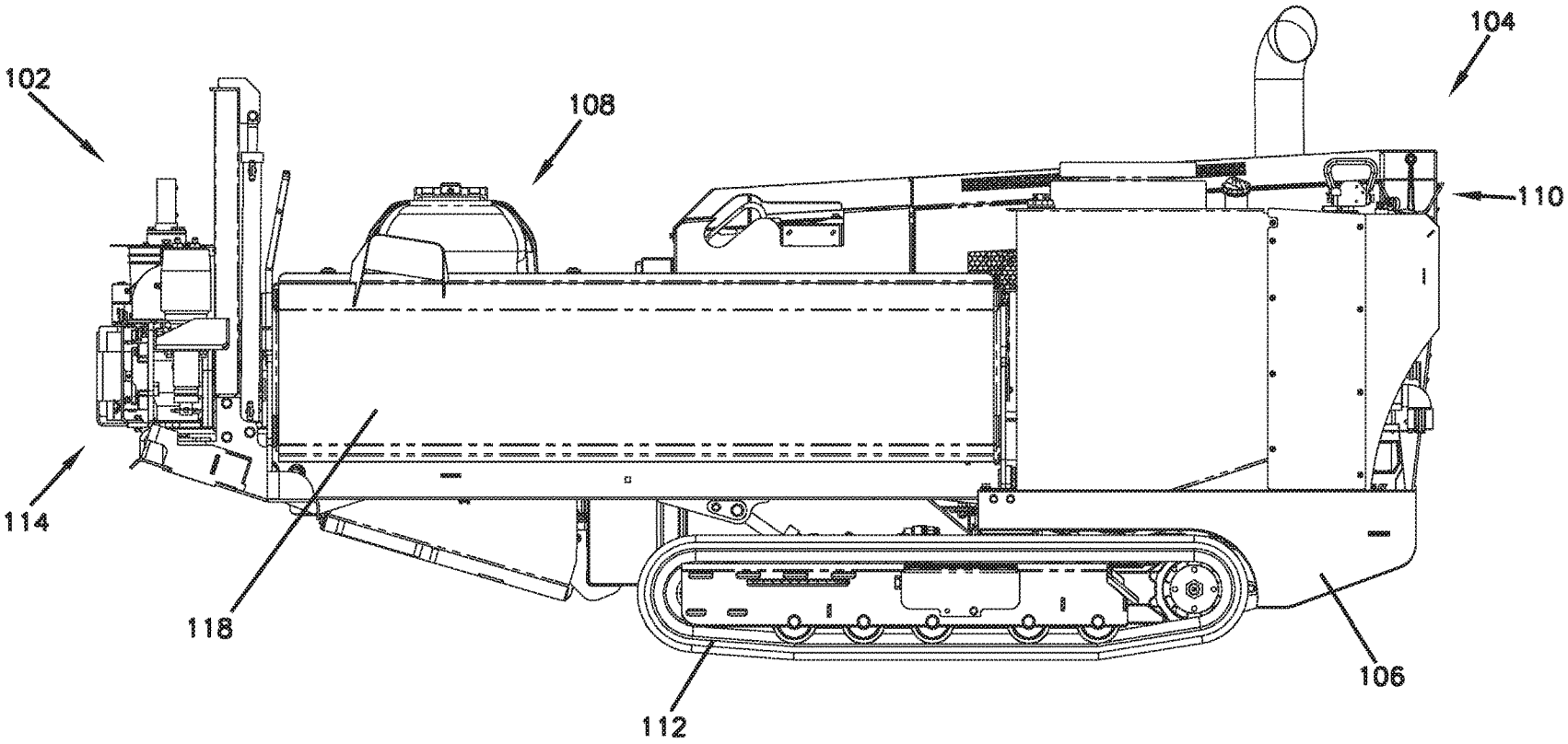
FIG. 2 illustrates a side view of the HDD machine of FIG. 1 in the inactive position.

FIGS. 1-2 show the HDD machine 100 in an inactive position. The HDD machine 100 includes a front end 102 and a rear end 104. The HDD machine 100 also includes a frame 106, a front operator's station 108, a rear operator's station 110, a pair of tracks 112, a drilling assembly 114, an engine housing 116, and a rod box 118. When in the inactive position, the HDD machine 100 can be transported by trailer, driven to a worksite, or parked and stored between drilling operations. The inactive position allows the HDD machine 100 to maintain a compact footprint while also allowing the HDD machine 100 to be in an inactive position to prevent accidental or unintended operation of the HDD machine 100. In one variation, the compact footprint includes an overall inactive machine width of about 36 inches or less, thus facilitating navigation through a typical yard or garden gate. In another variation, the compact footprint includes an overall inactive machine width of about 42 inches or less, thus facilitating navigation through a typical yard or garden gate When moving the HDD machine 100, an operator can control the movement of the pair of tracks 112, and therefore the HDD machine 100, by driving the HDD machine 100 from the rear operator's station 110.

Figure 3:
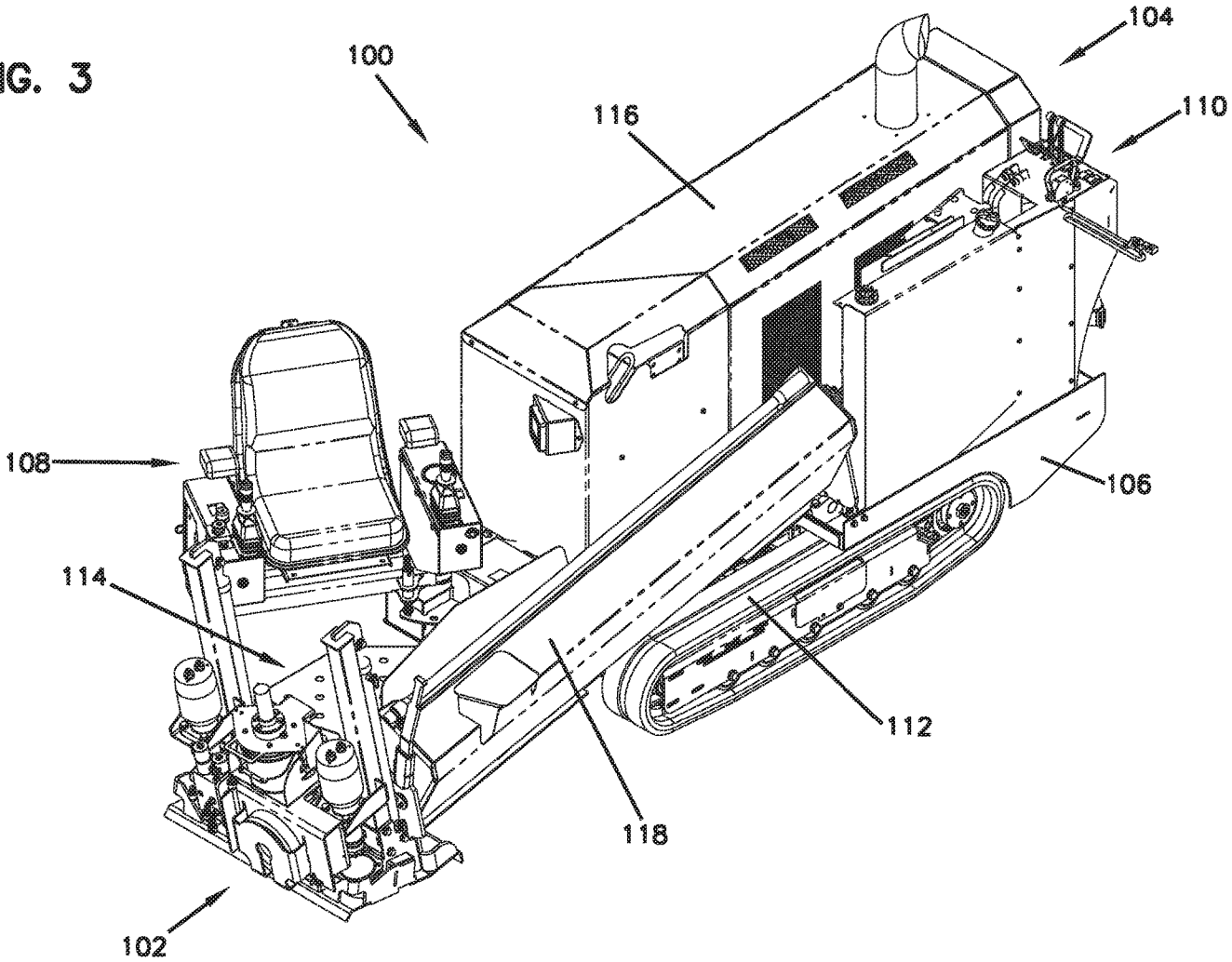
FIG. 3 illustrates a perspective view of the HDD machine of FIG. 1 in a working position.
Figure 4:
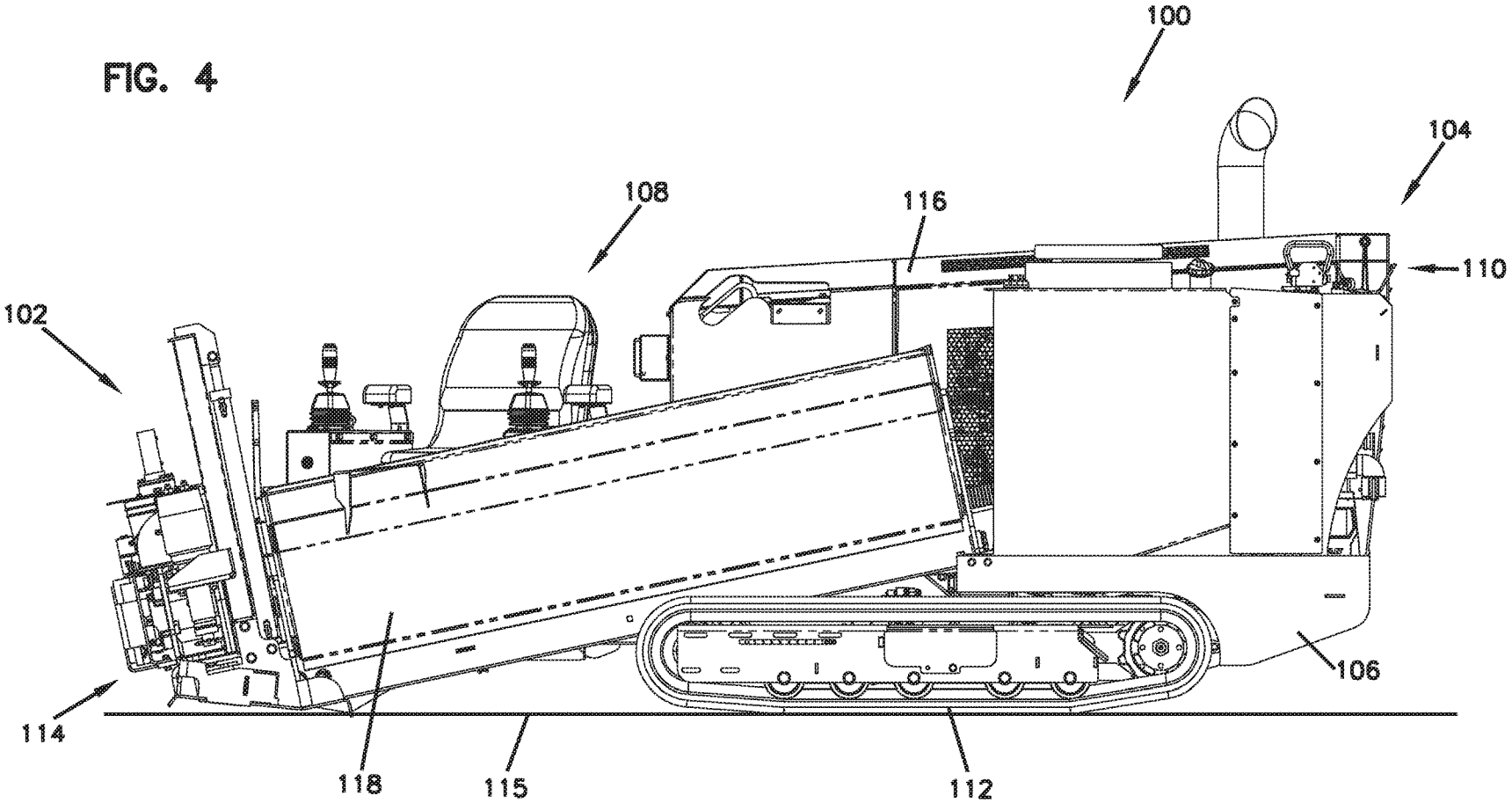
FIG. 4 illustrates a side view of the HDD machine of FIG. 1 in a working position.

FIGS. 3-4 show the HDD machine 100 in a working position. In the working position, the HDD machine 100 is configured to perform a drilling operation that includes driving a drill string underground along a generally horizontal path at the worksite. In the depicted embodiment, certain components of the HDD machine 100 are configured to move when the HDD machine 100 moves from the inactive position to the working position. In some embodiments, the front operator's station 108 is capable of swinging away from the HDD machine 100 so as to allow an operator a clear line of sight to the drilling assembly 114 and also allow the operator access to a plurality of different controls and to the rod box 118. The drilling assembly 114 is configured to tilt toward the front end 102 of the HDD machine 100 when the HDD machine 100 moves from the inactive position to the working position. This allows the drilling assembly 114 to deliver a drill rod into a ground surface 115 at the worksite at an oblique angle. Finally, in the depicted embodiment, the rod box 118 is pivotally movable relative to the frame 106, so as to allow the rod box 118 to pivot away from the HDD machine 100 when the HDD machine 100 moves from the inactive position to the working position.

The frame 106 of the HDD machine 100 is configured to support the operator's stations 108,110, drilling assembly 114, engine housing 116, and rod box 118. The frame 106 provides structural support to the HDD machine 100.

The front operator's station 108 is positioned near the front end 102 of the HDD machine 100. The front operator's station 108 is configured to allow an operator to control the operation of the HDD machine 100 from a seated position. The rear operator's station 110 is positioned near the rear end 104 of the HDD machine 100 and allows the operator to operate the HDD machine 100 from a standing position.

The tracks 112 are configured to allow the operator to move the HDD machine 100. In some embodiments, the tracks 112 have a width that is less than a trailer width so that the HDD machine 100 may be transported long distances via a trailer on public roads. In some embodiments, the HDD machine 100 may have a width so as to be simultaneously transported adjacent to other machines on a flatbed trailer.

The drilling assembly 114 is configured to provide thrust and rotational force to a series of drill rods (i.e., a drill string) during a drilling operation. Additionally, the drilling assembly 114 is configured to add and remove drill rods to and from the drill string. The drilling assembly 114 is powered by engine components (not shown) located within the engine housing 116.

The engine housing 116 is configured to cover the engine components that enable the HDD machine 100 to operate. The engine components can include a prime mover, and its components, and a hydraulic system and its components. The prime mover can be an internal combustion engine, electric motor, or other similar hybrid-type engine. In some embodiments, the engine housing 116 is mounted to the frame 106 of the HDD machine 100. The engine housing 116 is configured to include a multitude of panels, some of which may be removable.

The rod box 118 (i.e., a magazine or rack), which will be discussed in more detail with respect to FIG. 13-18, is configured to store a plurality of drill rods. The rod box 118 is also configured to allow drill rods to be readily removed and added to the rod box 118 during a drilling operation. In some embodiments, the rod box 118 can store a quantity of drill rods to allow a drilling operation to be completed without the need to retrieve drill rods from an additional storage location. In some embodiments, the rod box 118 can store about 150 feet of drill rods.

Figure 5:
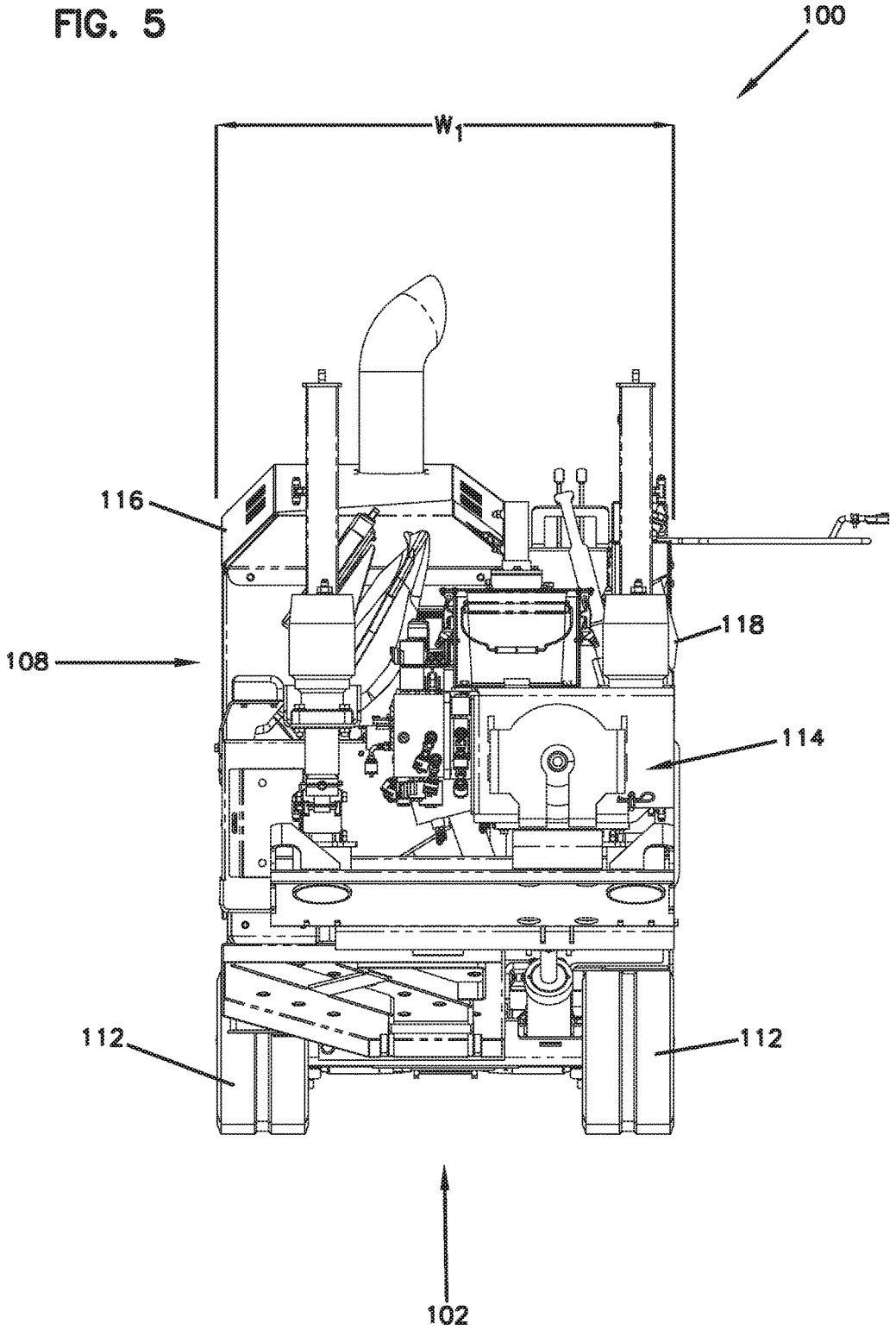
FIG. 5 illustrates a front view of the HDD machine of FIG. 1 in the inactive position.
Figure 6:
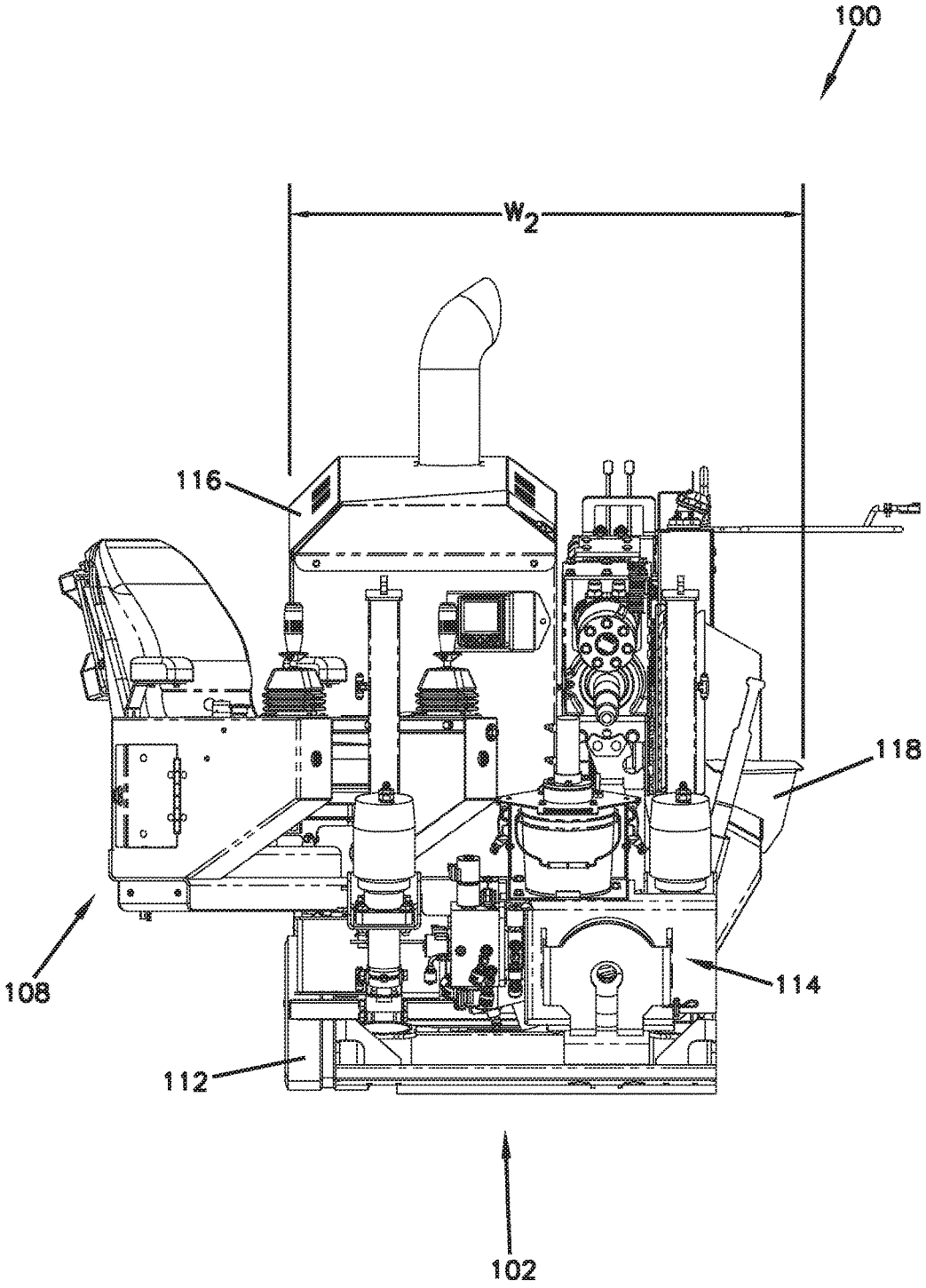
FIG. 6 illustrates a front view of the HDD machine of FIG. 1 in a working position.

FIG. 5 shows a front view of HDD machine 100 in the inactive position. In the inactive position, the HDD machine 100 has a first machine width of W1, which may also be considered to be a stowed or compact width W1. In some embodiments, W1 is a width that is less than about 36 inches. In some embodiments, the width W1 is less than the width of a standard garden/yard gate. FIG. 6 shows a front view of the HDD machine 100 in the working position. As shown, the HDD machine 100 has a second machine width of W2, which may be considered the expanded or working width W2. W2 is greater than W1. In the depicted embodiment, W2 is measured from the widest portion of the engine housing 116 to the widest portion of the rod box 118. In some embodiments, the front operator's station 108 is also movably pivotable in a direction laterally away from the HDD machine 100, which can also increase the HDD machine 100's working width W2.

Figure 7:
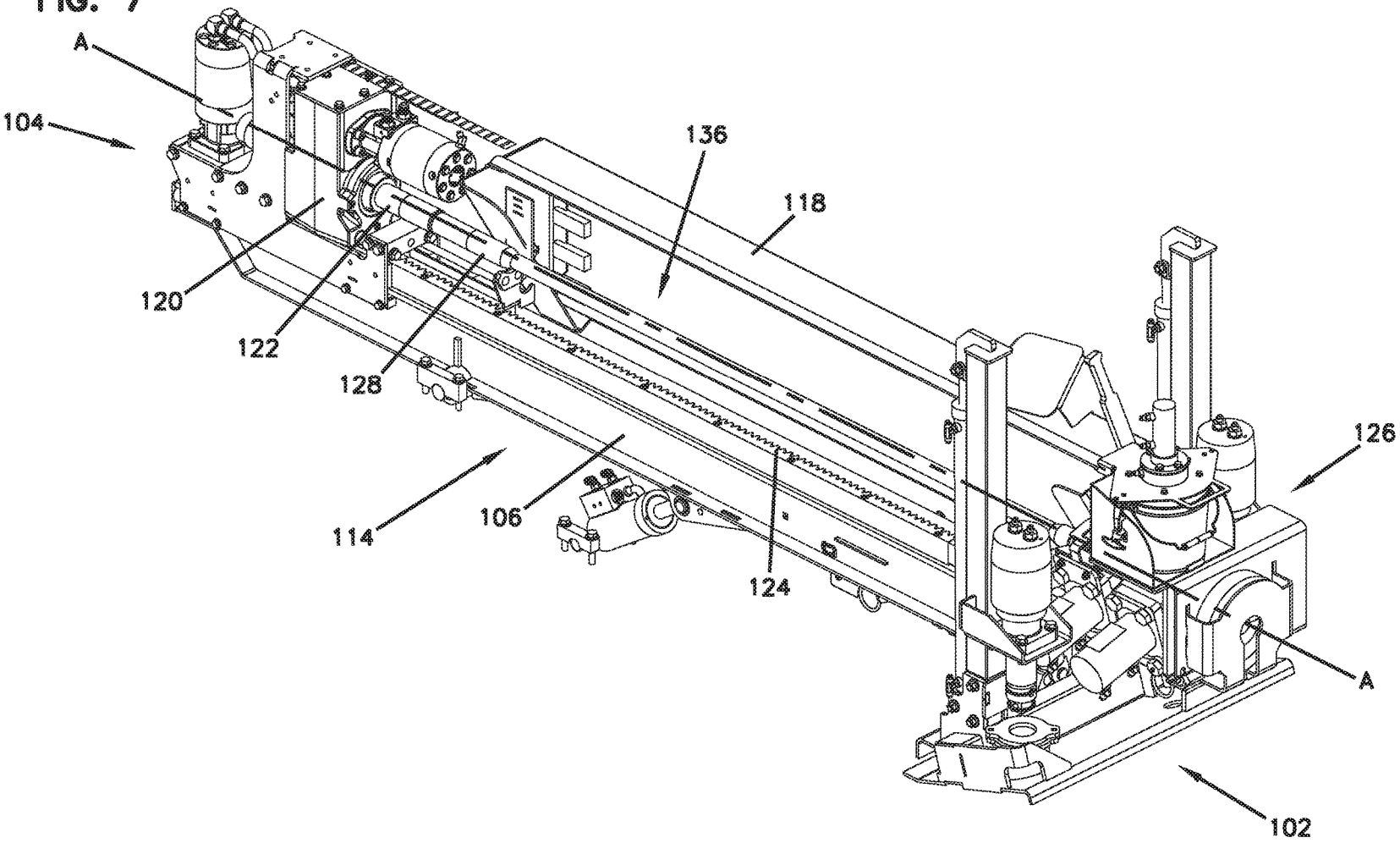
FIG. 7 illustrates a perspective view of a drive assembly, a frame, and a rod box in a stowed position of an HDD machine, according to one embodiment of the present disclosure.
Figure 8:
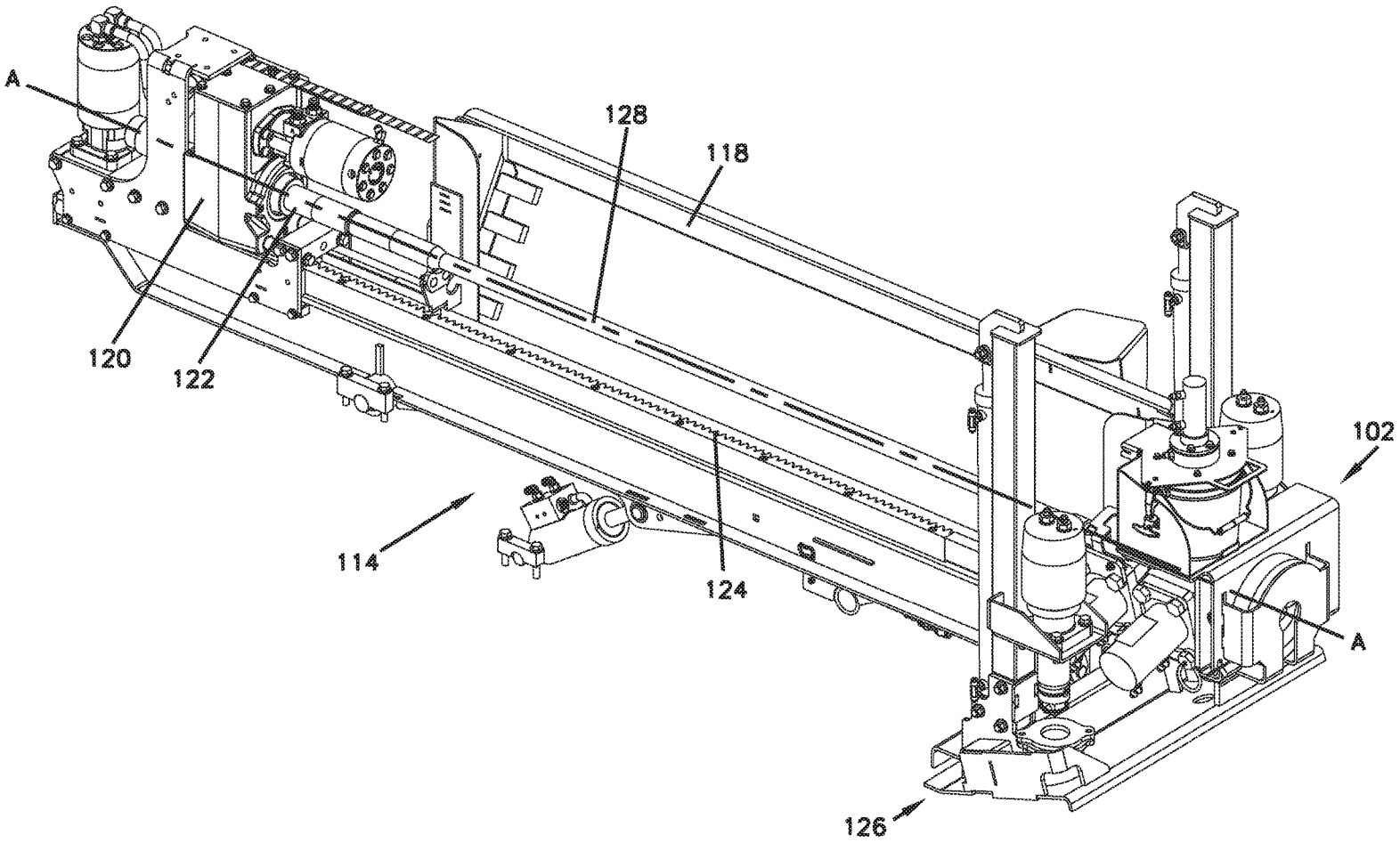
FIG. 8 illustrates a perspective view of the drive assembly, the frame, and the rod box of FIG. 7 with the rod box in an operational position.
Figure 9:
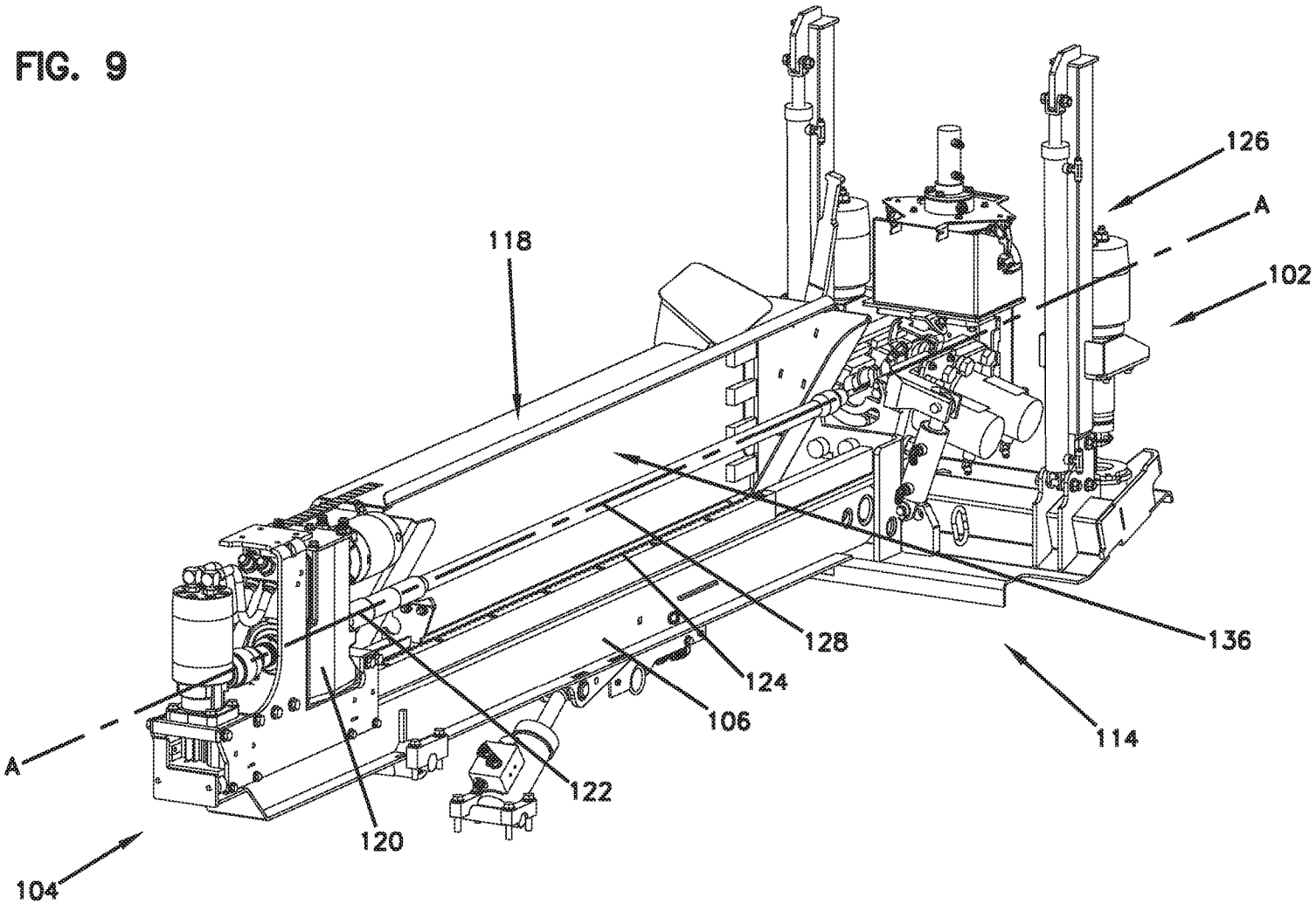
FIG. 9 illustrates a rear perspective view of the drive assembly, the frame, and the rod box of FIG. 7 with the rod box in a stowed position.
Figure 10:
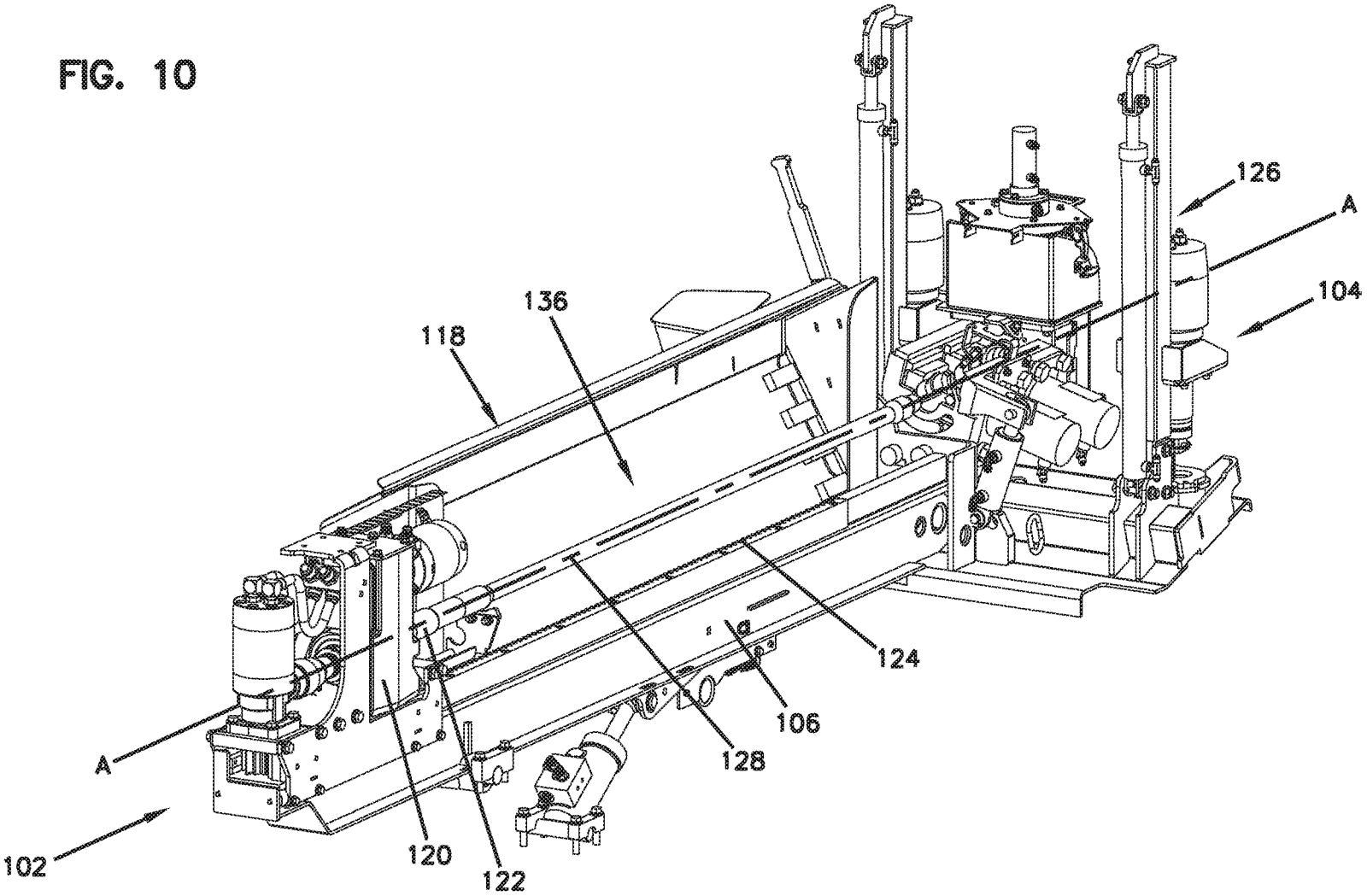
FIG. 10 illustrates a rear perspective view of the drive assembly, the frame, and the rod box of FIG. 7 with the rod box in an operational position.

FIGS. 7-8 show perspective views of the drilling assembly 114, the rod box 118, and the frame 106. In FIG. 7, the rod box 118 is shown in the stowed position. In FIG. 8, the rod box 118 is, in turn, shown in the operational position. FIGS. 9-10 show rear perspective views of the drilling assembly 114, the rod box 118, and frame 106. In FIG. 9, the rod box 118 is shown in the stowed position. In FIG. 10, the rod box 118 is shown in the operational position. The drilling assembly 114 includes a drill head 120, a spindle 122, a drill head track 124, and a vise/anchor assembly 126. The drill head 120 provides thrust and rotational power to the spindle 122 and moves a drill rod 128 along a longitudinal axis A of the drilling assembly 114.

When performing a drilling operation, first, the rod box 118 is moved to the operational position. The drill rod 128 is then removed from the rod box 118 and connected to the spindle 122. Once connected to the spindle 122, the drill head 120 travels along the drill head track 124, moving the drill rod 128 in a direction toward the front 102 of the HDD machine 100. In some examples, the drill head 120 can travel along the drill head track 124 via gears (i.e., a rack and pinion gear). In other examples, the drill head track 124 can include cylinders or cables to propel the drill head 120 along the drill head track 124. Once the drill head 120 is adjacent the vise/anchor assembly 126, the drill rod 128 is removed from the spindle 122, and the drill head 120 travels backward in a direction away from the front 102 of the HDD machine 100 along the drill head track 124 so that another drill rod can be added. Such a process is repeated until the drill string is complete. Further, while no drill rod loading mechanism is shown in the FIGS., in some embodiments, a drill rod loading mechanism can be utilized to move drill rod from the rod box 118 to the drilling assembly 114.

Figure 11:
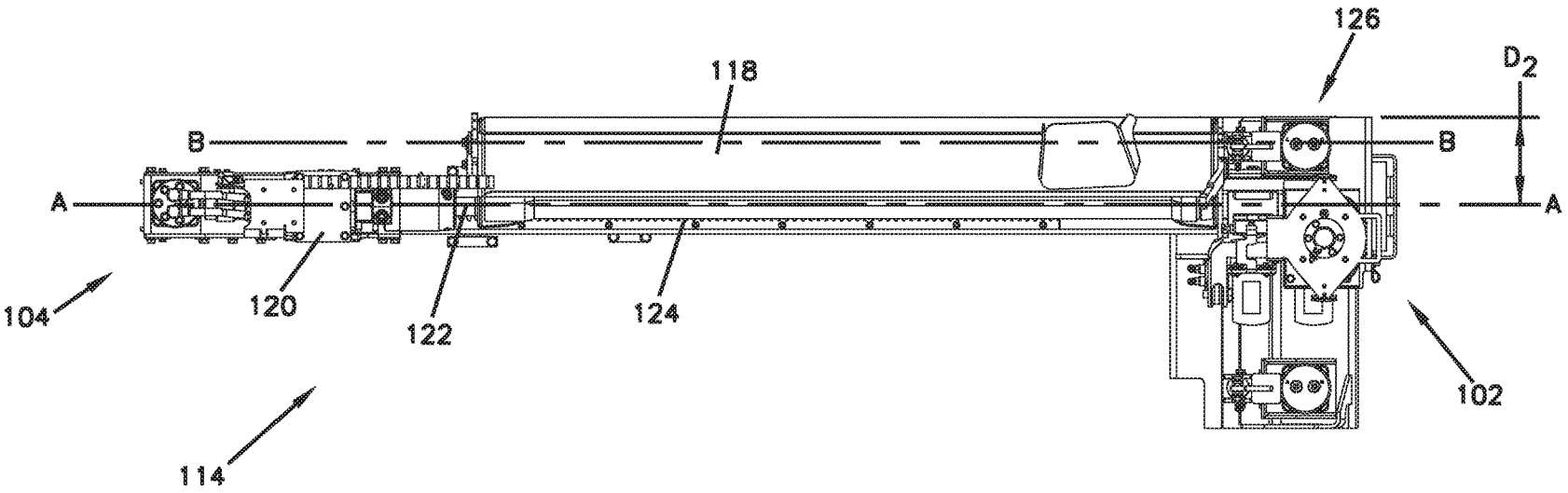
FIG. 11 illustrates a top view of the drive assembly, the frame, and the rod box of FIG. 7 with the rod box in the stowed position.
Figure 12:
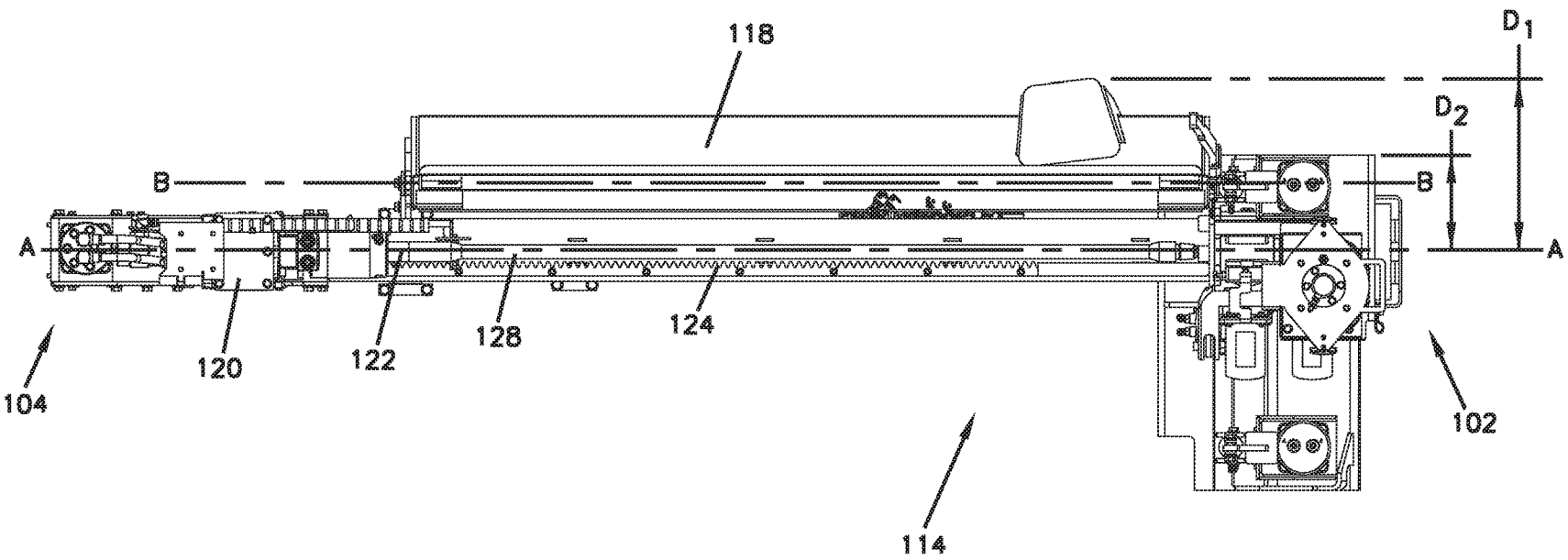
FIG. 12 illustrates a top view of the drive assembly, the frame, and the rod box of FIG. 7 with the rod box in the operational position.

FIGS. 11-12 show a top view of the drilling assembly 114 and the rod box 118. FIG. 11 shows the rod box 118 in the stowed position, and FIG. 12 shows the rod box 118 in the operational position. As shown in FIG. 11, when pivoted into the stowed position, the rod box 118 blocks the movement of the drill head 120 along the drill head track 124 toward the vise/anchor assembly 126. Specifically, the rod box 118 overlaps the longitudinal axis A of the drilling assembly 114 when the rod box 118 is in the stowed position. Further, when in the stowed position, the furthest portion of the rod box 118 from the longitudinal axis A is a distance D2. Due to the rod box 118 being generally low in height compared to the HDD machine 100, and the fact that the rod box 118 overlaps the longitudinal axis A when in the stowed position, the rod box 118 helps to position the HDD machine 100's center of gravity closer to the ground and closer to the longitudinal axis A. This can be important, for example, when transporting the HDD machine 100 and also when performing drilling operations on uneven ground or a surface with a grade.

As shown in FIG. 12, the rod box 118 pivots about a pivot axis B proximate a bottom or base (not labelled) of the rod box 118, so as to move between the stowed position and the operational position thereof, and, when moved into the operational position, the rod box 118 does not overlap the longitudinal axis A. Not being overlapped with the longitudinal axis A allows the drill head 120 to travel along the drill head track 124. Further, when in the operational position, the furthest portion of the rod box 118 from the longitudinal axis A is a distance D1. As shown, D1 is greater than D2. Also, the pivot axis B and the longitudinal axis A are generally parallel.

Figure 13:
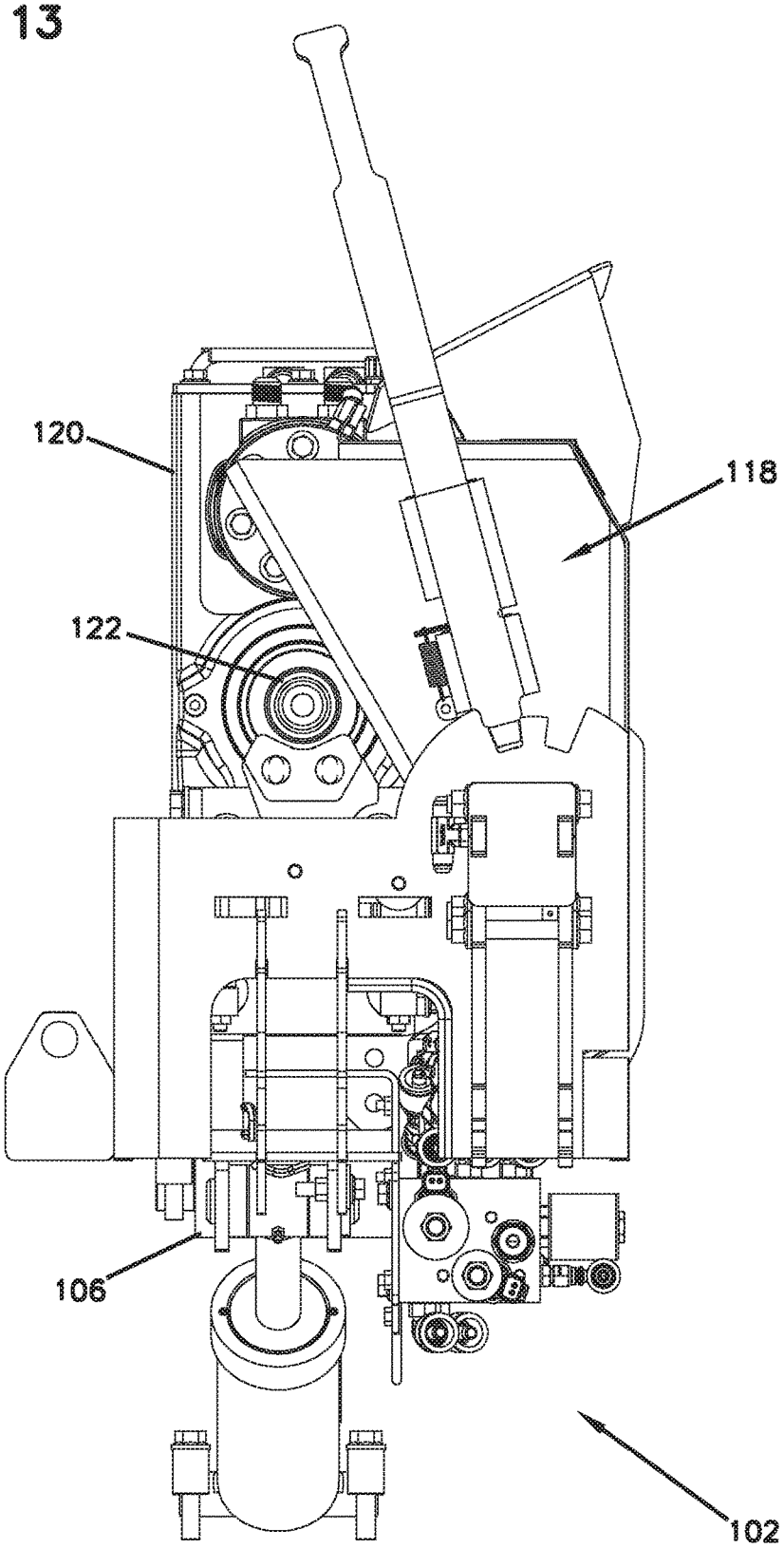
FIG. 13 illustrates a front view of the drive assembly, the frame, and the rod box of FIG. 7 with the rod box in the stowed position.
Figure 14:
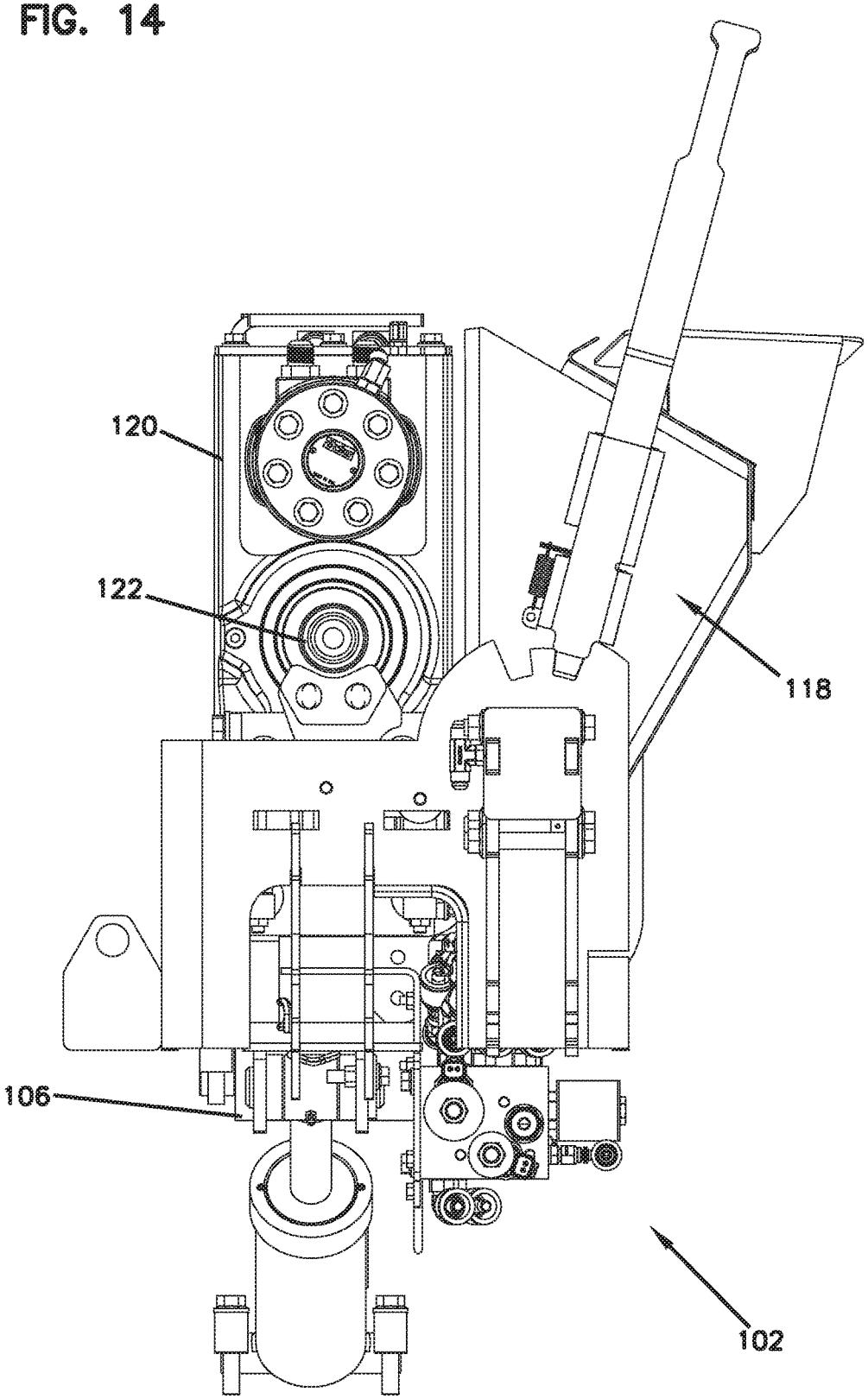
FIG. 14 illustrates a top view of the drive assembly, the frame, and the rod box of FIG. 7 with the rod box in the operational position.
Figure 15:
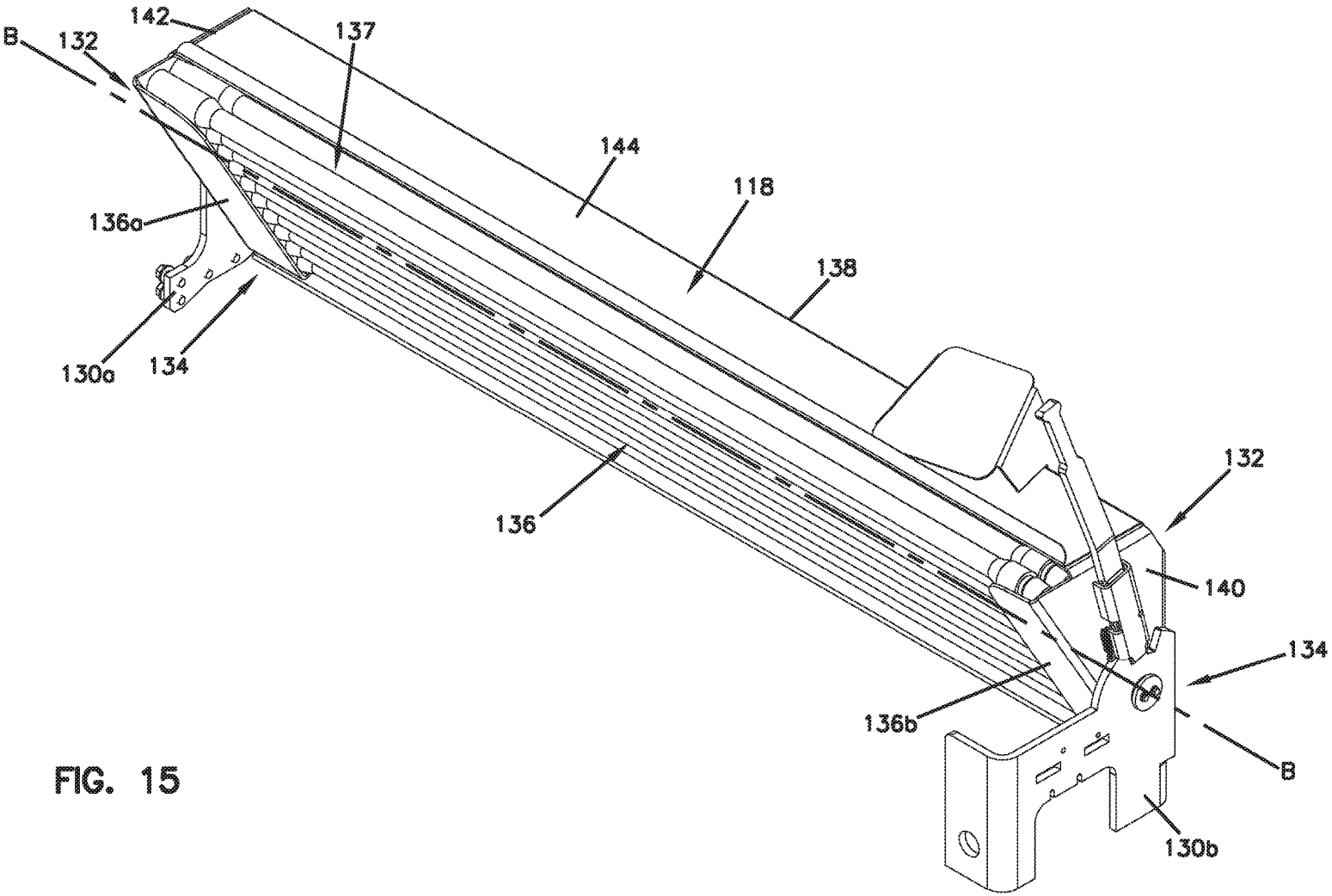
FIG. 15 illustrates a perspective view of a rod box, according to one embodiment of the present disclosure.

FIG. 13 shows a front view of the drilling assembly 114 and the rod box 118 in the stowed position. FIG. 14 shows a front view of the drilling assembly 114 and the rod box 118 in the operational position. As shown, the rod box 118 is attached to the frame 106 with a pair of arms 130.

FIGS. 15-21 show the rod box 118 detached from the HDD machine 100. The rod box 118 is configured to hold a plurality of drill rods in a position that is in close proximity to the drilling assembly 114. The rod box 118 has an upper end 132 and a lower end 134 and is pivotally attached at a pivot connection 135 to the arms 130 at the lower end 134 so as to be movable about pivot axis B. Further, the rod box 118 has a generally open side 136, a closed side 138, a front end 140, a back end 142, and a partially open top side 144. The rod box 118 has a generally triangular cross section, and, in some embodiments, the rod box 118 is tapered so that the width is larger adjacent the upper end 132 of the rod box 118 as compared to the lower end 134 of the rod box 118. Additionally, the upper end 132, via the partially open top side 144, provides user access to the drill rods stored within the rod box 118.

Figure 16:
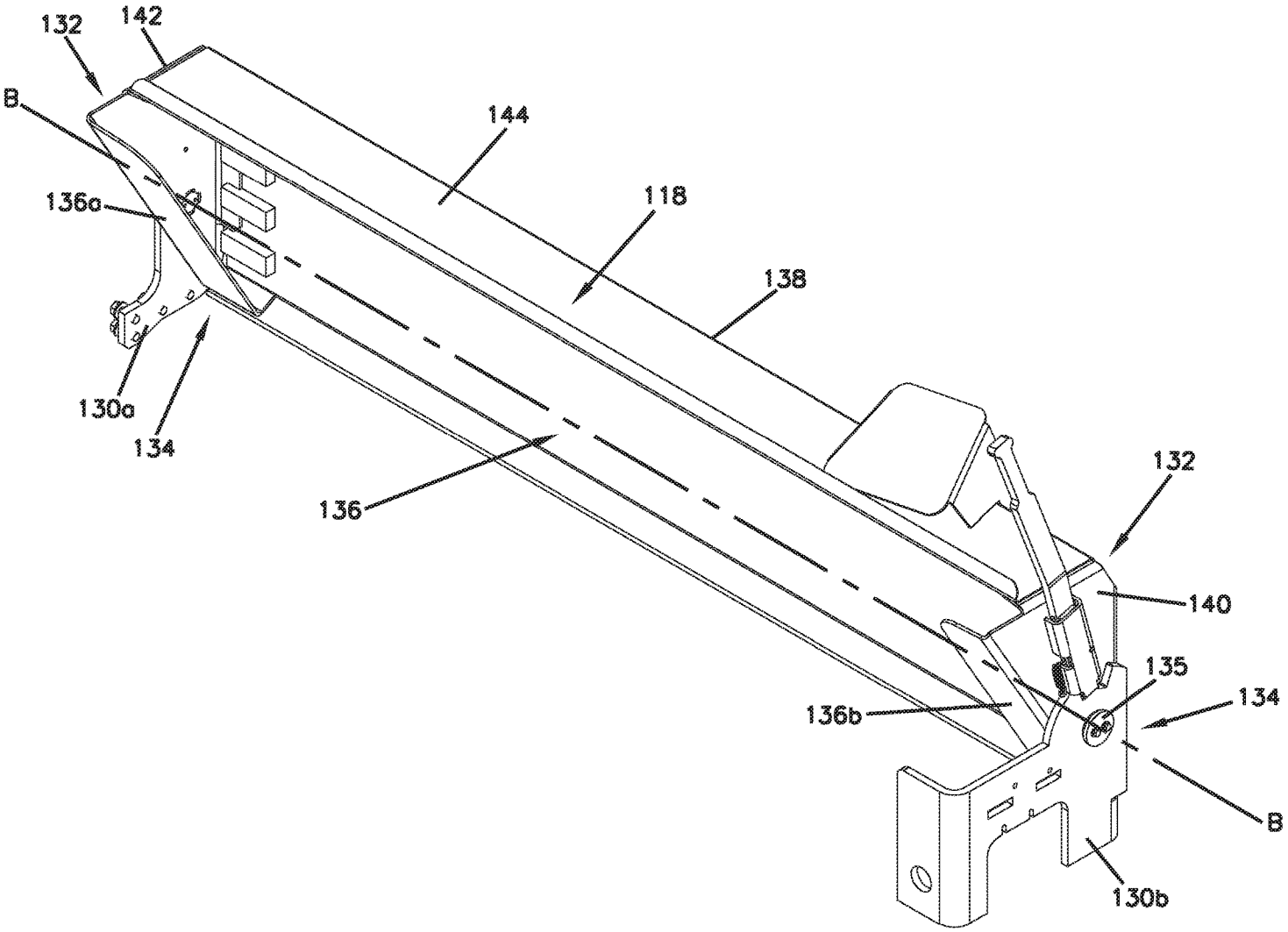
FIG. 16 illustrates a perspective view of a rod box of FIG. 15 empty of drill rods.
Figure 17:
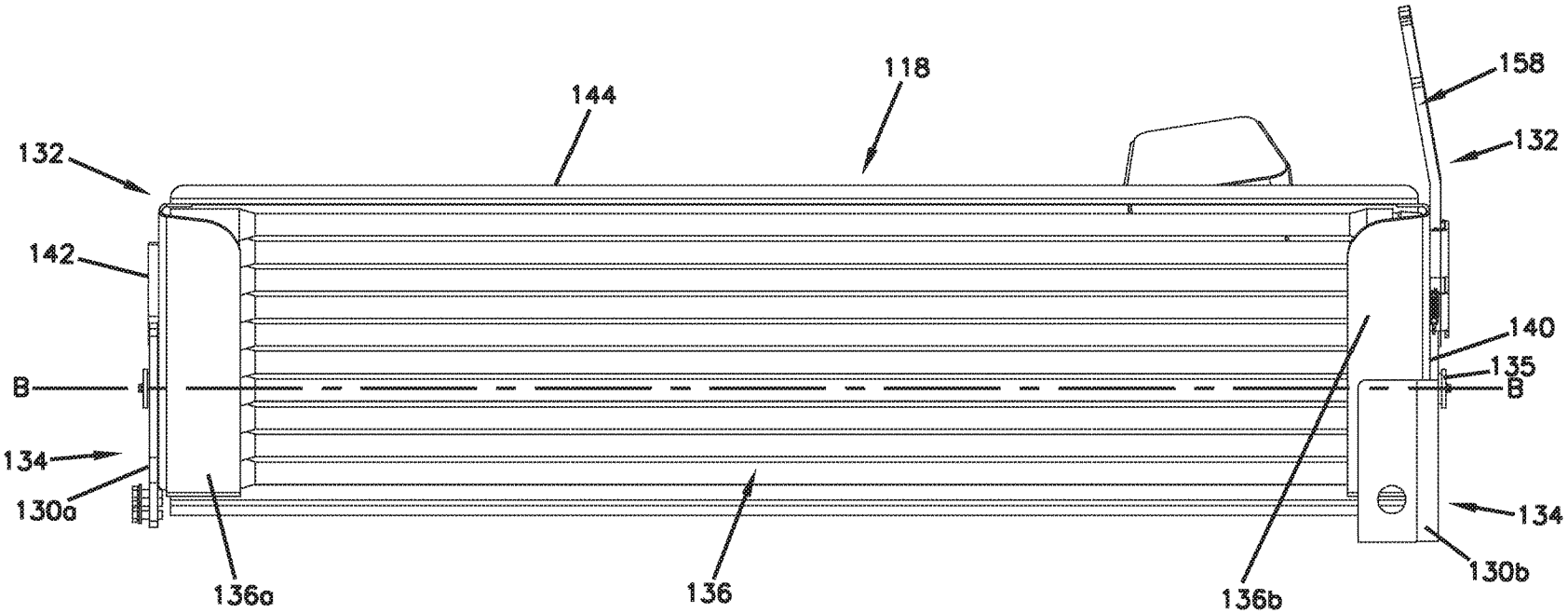
FIG. 17 illustrates a side view of the rod box of FIG. 15.

FIG. 16 shows the rod box 118 empty of drill rods. The rod box 118 has an open interior structure that does not include structure defining any pre-defined rows or columns for the drill rods.

The generally open side 136 of the rod box 118 is configured to face toward the drill head track 124 of the drilling assembly 114. The generally open side 136 includes open side elements 136*a* and 136*b* which serve to retain the drill rods within the rod box 118, while still providing a substantially open profile therebetween. By having a generally open side 136 and a partially open top side 144 as part of the overall rod box construction, the rod box 118 is able to substantially retain the drill rods yet still establish a rod access zone 137. In some embodiments, the rod access zone 137 corresponds with the open top side 144. In other embodiments, the rod access zone 137 can correspond to a portion of the open side 136. Via the rod access zone 137, the operator of the HDD machine 100 can manually remove and replace drill rods to and from the rod box 118 during a drilling operation. Specifically, the operator can remove and replace drill rods from the rod access zone 137 and do so while operating the HDD machine 100 from the operator's station 108, as shown in FIG. 3.

Figure 19:
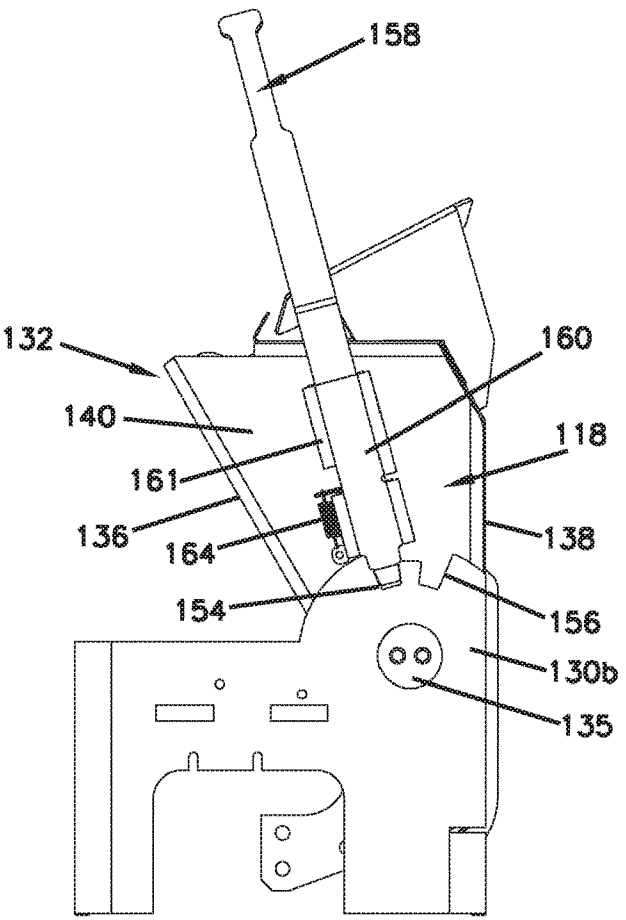
FIG. 19 illustrates a front end view of the rod box of FIG. 15 in the stowed position.
Figure 18:
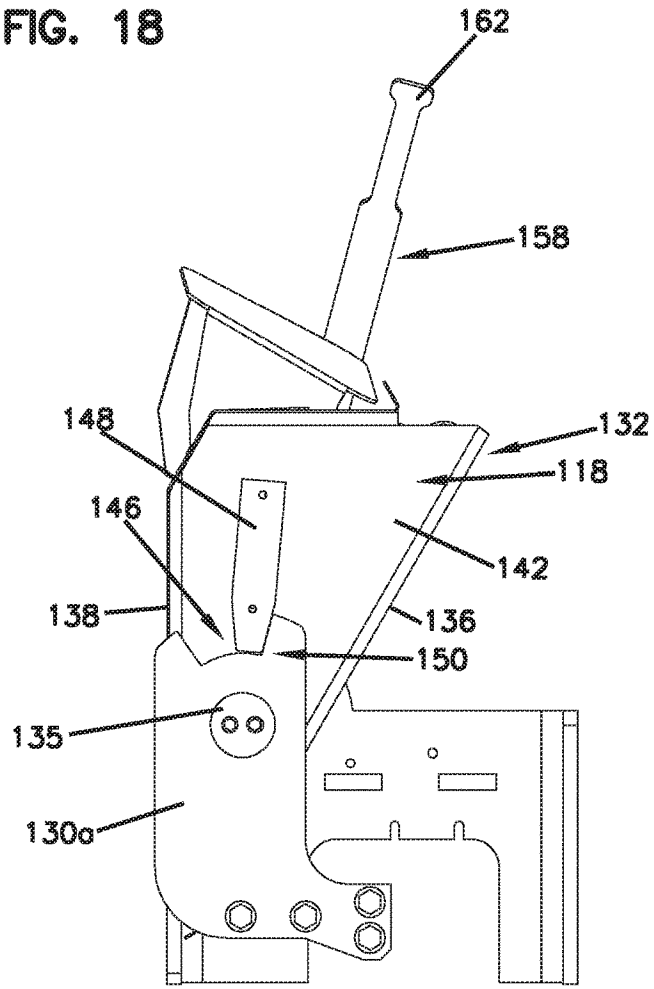
FIG. 18 illustrates a back end view of the rod box of FIG. 15 in the stowed position.
Figure 21:
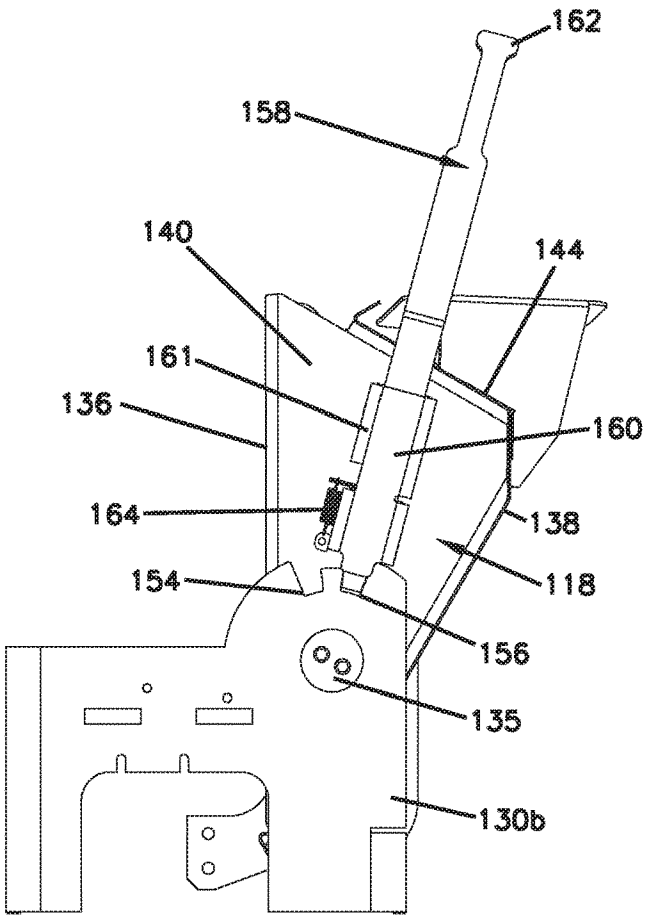
FIG. 21 illustrates a front end view of the rod box of FIG. 15 in the operational position.
Figure 20:
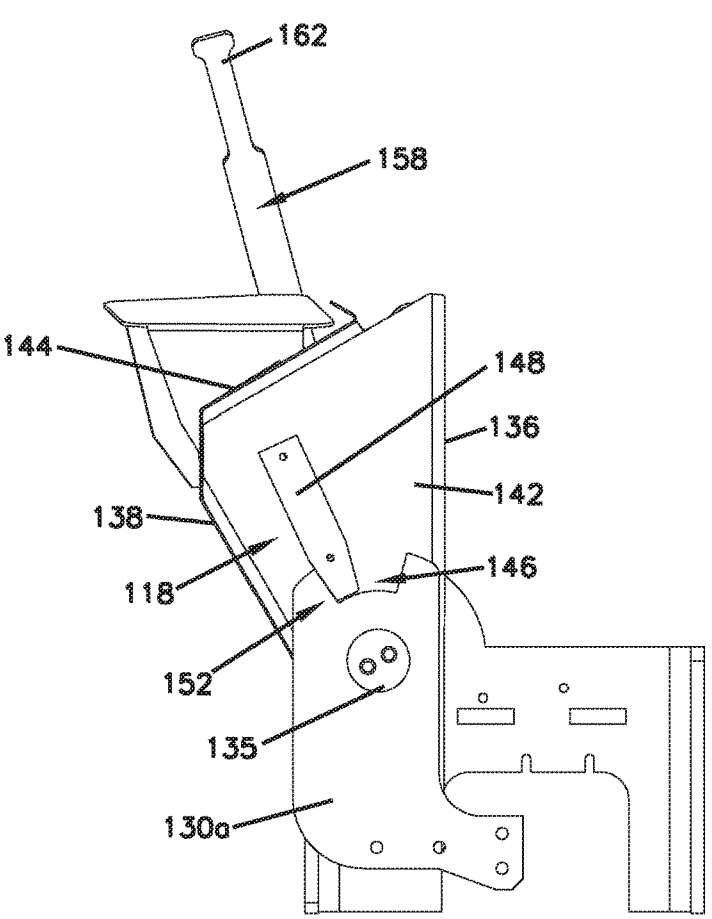
FIG. 20 illustrates a back end view of the rod box of FIG. 15 in the operational position.

FIGS. 18-19 show the ends 140, 142 of the rod box 118 when the rod box 118 is in the stowed position. When the rod box 118 is in the stowed position, the generally open side 136 is angled relative to vertical, while the closed side 138 is generally vertical. FIGS. 20-21 show the ends 140, 142 of the rod box 118 when the rod box 118 is in the operational position. When the rod box 118 is in the operational position, the open side 136 is generally vertical while the closed side 138 is generally angled relative to vertical.

As shown, the arms 130*a*/130*b* include positive stops to prevent the over-rotation of the rod box 118 when moving the rod box 118 between the stowed and operational positions. Specifically, the arm 130*a* that is positioned near the back end 142 of the rod box 118 includes a channel 146, with the shape of the channel 146 inherently posing a pair of travel limits. The back side 142 of the rod box 118 includes a peg 148 that is configured to travel within the travel limits (i.e., first and second sides 150, 152) established by the channel 146 of the arm 130*a*. As shown in FIG. 18, the peg 148 is positioned at a first side 150 of the channel 146 when the rod box 118 is in the stowed position. When the rod box 118 is moved to the operational position shown in FIG. 19, the peg 148 slides within the channel 146 and is positioned at a second end 152 of the channel 146.

Arm 130*b* positioned near the front end 140 of the rod box 118 includes a stowed pocket 154 and an operational pocket 156. The pockets 154, 156 are configured to interface with a movable lever 158 that is movably secured to the front end 140 of the rod box 118. The movable lever 158 is positioned within a lever channel 160 and also includes a handle 162. In the depicted example, the lever channel 160 is defined by a bracket 161 attached to the rod box 118. In the depicted embodiment, the lever 158 is spring loaded and biased in a downward direction toward the arm 130*b* by a spring 164. As shown in FIG. 19, when the rod box 118 is in the stowed position, the lever 158 is positioned within the stowed pocket 154 of the arm 130*b*. When moved to the operational position, as shown in FIG. 21, the lever 158 is moved in an upward direction by the operator and then positioned within the operational pocket 156 of the arm 130*b*. The stowed and operational pockets 154, 156 of arm 130*b* combined with the movable lever 158 allow the rod box 118 to be locked in either the stowed or operational positions.

While movement of the rod box 118 disclosed herein is described as being controlled manually by the operator, in other embodiments, the movement of the rod box 118 can be controlled by a hydraulic or pneumatic actuator.

Figure 22:
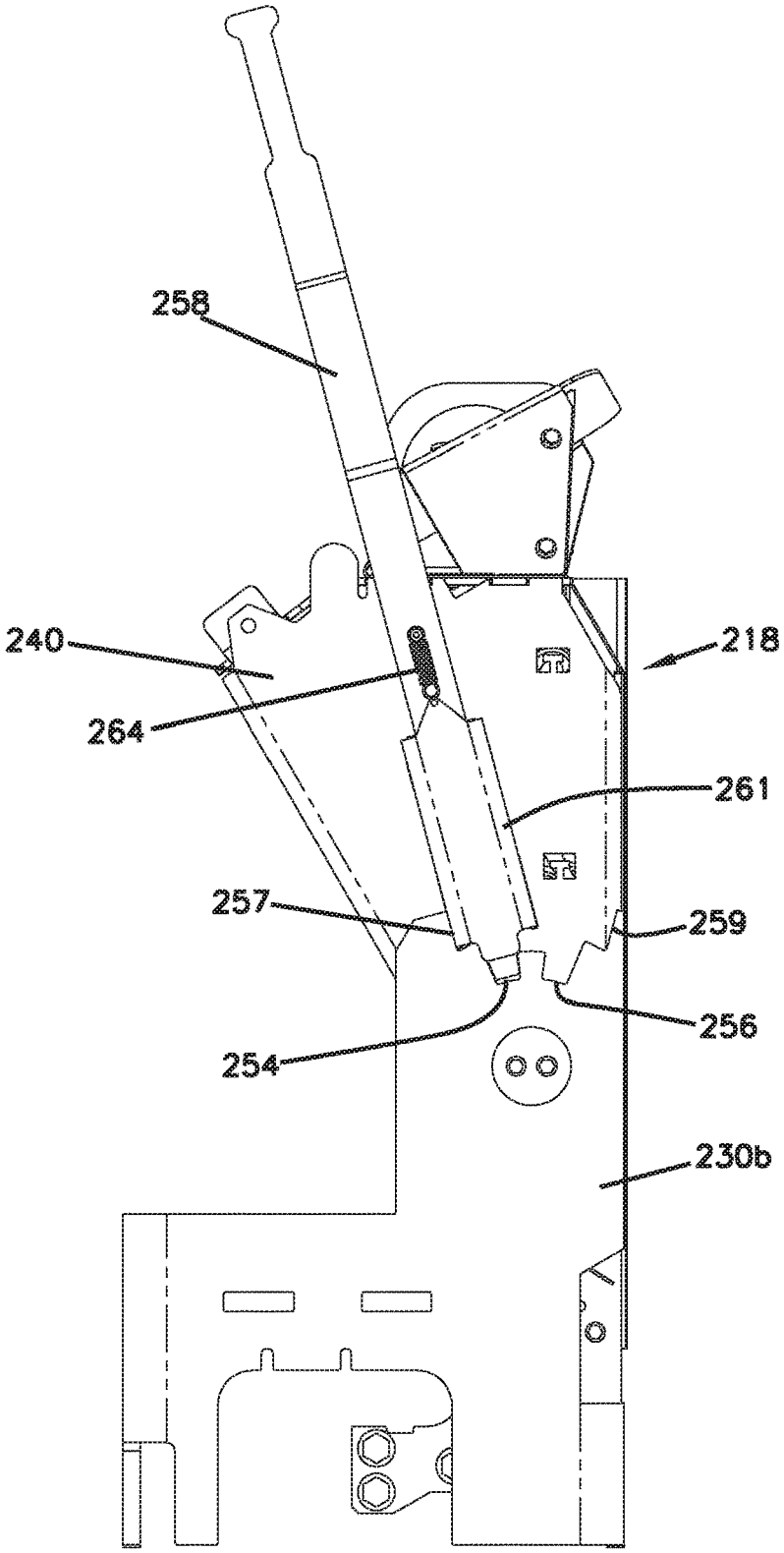
FIG. 22 illustrates a back end view of a rod box in the stowed position, according to one embodiment of the present disclosure.
Figure 23:
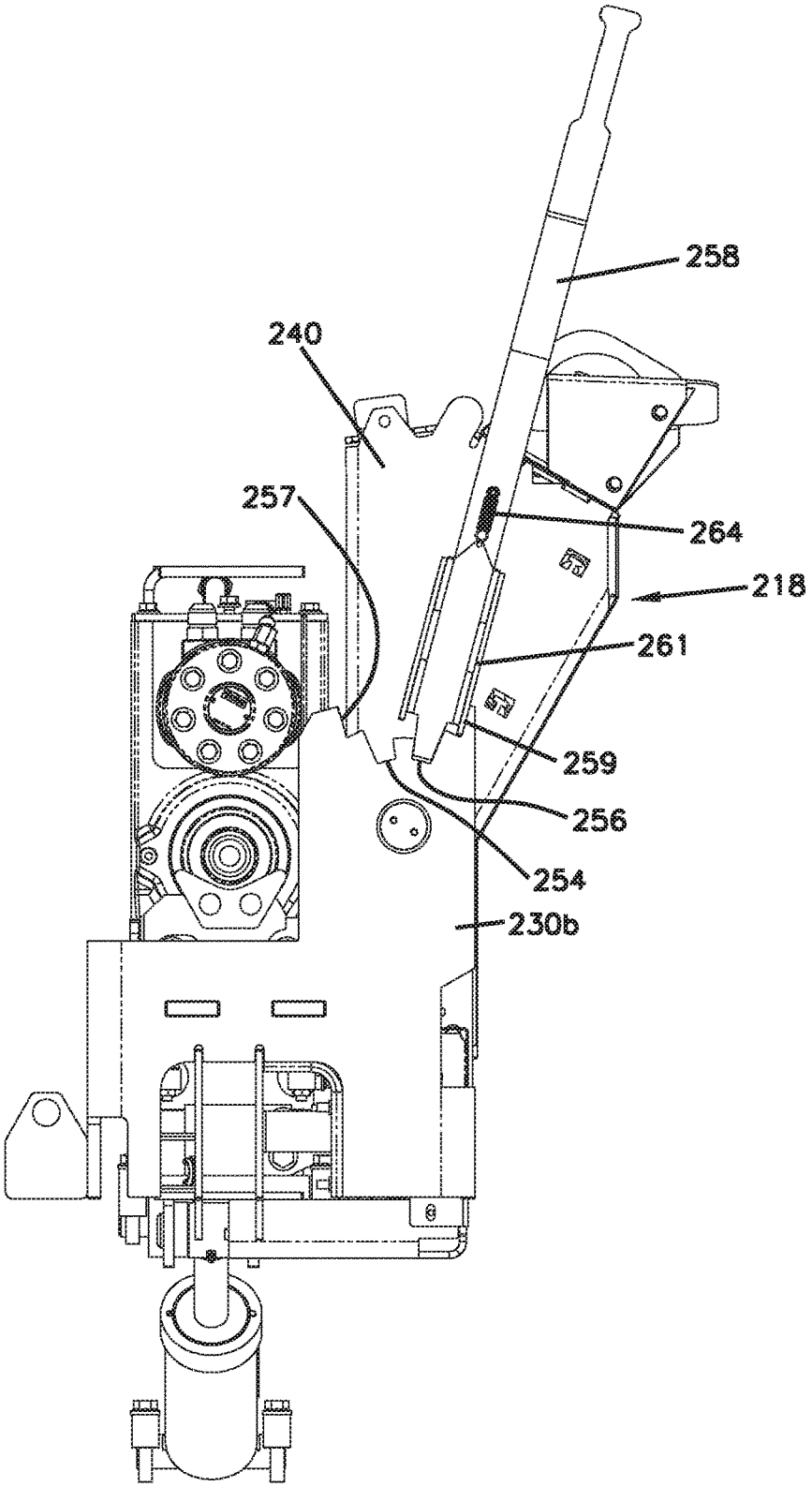
FIG. 23 illustrates a back end view of the rod box of FIG. 22 in the operational position.

FIGS. 22 and 23 show a rod box 218, according to another embodiment of the present disclosure. FIG. 22 shows a front end 240 of the rod box 218 when the rod box 218 is in the stowed position. FIG. 23 shows the rod box 218 in an operational position. The rod box 218 is substantially similar to the rod box 118 described above.

The rod box 218 is attached to the frame 106 with a pair of arms 230*a*, 230*b*. The arm 230*a* is substantially similar to arm 130*a* described above, and arm 230*b* is similar to arm 130*b*. Like arm 130*b*, arm 230*b* includes a stowed pocket 254 and an operational pocket 256. The pockets 254, 256 are configured to interface with a movable lever 258 that is movably secured to the rod box 218. The arm 230*b* also includes a stowed hard stop 257 and an operational hard stop 259 that aid in retaining the rod box 218 in either the stowed or operational position.

The movable lever 258 is positioned within a lever channel 260 that is defined by a bracket 261 that is attached to the rod box 218. The lever 258 is spring loaded by a spring 264 attached to the lever 258 and the bracket 261 and biased in a downward direction toward the arm 230*b*.

As shown in FIG. 22, like the rod box 118, when the rod box 218 is in the stowed position, the lever 258 is positioned within the stowed pocket 254 of the arm 230*b*. In the depicted embodiment, the bracket 261 of the rod box 218 is also in contact with the stowed hard stop 257 of the arm 230*b*. The stowed hard stop 257 helps prevent the rod box 218 from over-rotating while also removing excess force on the lever 258 when the rod box 218 is the stowed position. In some examples, the lever 258 can be loosely positioned within the stowed pocket 254 when in the stowed position while the weight of the rod box rests, via the bracket 261, on the stowed hard stop 257. In such an example, by positioning the lever 258 in the stowed pocket 254, the rod box 218 is prevented from rotating back in a direction toward the operational position. However, in regular use, the weight of the rod box 218 is supported by the stowed hard stop 257 and the bracket 261, thereby allowing the user to easily manipulate the lever 258 in an upward and downward motion without having to overcome excessive friction between the stowed pocket 254 and the lever 258. In some examples, the stowed hard stop 257 can be lined with a bumper material, such as a rubberized material.

When moved to the operational position, as shown in FIG. 23, the lever 258 is moved in an upward direction by the operator and then positioned within the operational pocket 256 of the arm 230*b*. Similar to the stowed hard stop 257 described above, the operational hard stop 259 is configured to interface with the bracket 261 so as to support the weight of the rod box 218 in the operational position and to prevent the rod box 218 from over rotating past the operational position. Further, like the stowed pocket 254, the lever 258 can be loosely positioned within the operational pocket 256 so as to prevent the rod box 218 from rotating back in a direction toward the stowed position. In some examples, the operational hard stop 259 can be lined with a bumper material, such a rubberized material.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A horizontal directional drilling machine for drilling a string of drill rods into the ground, the horizontal directional drilling machine comprising:

a frame supporting a drill head track defining a longitudinal axis;

a drill head mounted on the track, the drill head including a rotational rod drive;

a thrust mechanism for moving the drill head along the longitudinal axis of the drill head track between a retracted position adjacent a first end of the drill head track and an extended position adjacent an opposite second end of the track; and a rod box for holding a plurality of the drill rods, the rod box having an upper end and a lower end, the rod box being pivotally connected to the frame at a pivot axis positioned adjacent the lower end of the rod box, the pivot axis being oriented to extend along the longitudinal axis of the track, the rod box being pivotally movable about the pivot axis between a stowed position and an operational position, the rod box overhanging the longitudinal axis of the drill head track when in the stowed position in a manner so as to obstruct movement of the drill head from the retracted position to the extended position, the rod box being laterally offset from a region above the longitudinal axis of the drill head track when in the operational position in a manner so as to not interfere with movement of the drill head along the longitudinal axis, the rod box having a load/unload opening proximate the upper end of the rod box, the load/unload opening being configured for selectably allowing the drill rods to be manually loaded into the rod box and manually removed from the rod box, the rod box including a first side that faces toward the drill head track and a second side that faces away from the track, the load/unload opening being positioned adjacent the first side, the rod box defining a width that extends between the first and second sides, the rod box being tapered such that the width is larger adjacent the upper end of the rod box as compared to the lower end of the rod box, wherein the rod box can accommodate more drill rods across the width adjacent the upper end as compared to adjacent the lower end.

2. The horizontal directional drilling machine of claim 1, wherein the first side is vertical and the second side is angled relative to vertical when the rod box is in the operational position, and wherein the first side is angled relative to vertical and the second side is vertical when the rod box is in the stowed position.

3. The horizontal directional drilling machine of claim 1, wherein the horizontal directional drilling machine has a width less than or equal to 36 inches when the rod box is in the stowed position.

4. The horizontal directional drilling machine of claim 1, wherein the rod box has an open interior structure that does not include structure defining any pre-defined rows or columns for receiving drill rods.

5. The horizontal directional drilling machine of claim 1, wherein the width is at least twice as large adjacent the upper end of the rod box as compared to the lower end of the rod box.

6. The horizontal directional drilling machine of claim 1, wherein the frame includes a positive stop that interacts with the rod box to prevent rotation of the rod box past the operational and stowed positions.

7. The horizontal directional drilling machine of claim 1, wherein the rod box includes a lever for moving the rod box between the stowed position and operational position.

8. The horizontal directional drilling machine of claim 7, wherein the lever is slidably attached to the rod box and movable within a channel member associated with the rod box, and wherein the lever interfaces with the frame so as to lock the rod box in either the operational position or the stowed position.

9. The horizontal directional drilling machine of claim 8, wherein the frame includes an operational pocket and a stowed pocket, and wherein the lever of the rod box is positionable within the operational pocket when the rod box in the operational position and is positionable in the stowed pocket when the rod box is in the stowed position.

10. The horizontal directional drilling machine of claim 8, wherein the frame includes an operational hard stop and a stowed hard stop, and wherein a portion of the rod box is in contact with the operational hard stop when the rod box in the operational position and in contact with the stowed hard stop when the rod box is in the stowed position.

11. The horizontal directional drilling machine of claim 1, wherein the rod box is lockable and prevented from moving either in the stowed position or in the operational position.

12. A horizontal directional drilling machine for drilling a string of drill rods into the ground, the horizontal directional drilling machine comprising:

a frame supporting a drill head track defining a longitudinal axis, the longitudinal axis residing in a vertical reference plane generally perpendicular to the ground;

a drill head mounted on the track, the drill head including a rotational rod drive;

a thrust mechanism for moving the drill head along the longitudinal axis of the drill head track between a retracted position adjacent a first end of the drill head track and an extended position adjacent an opposite second end of the track; and a rod box for holding a plurality of the drill rods, the rod box having a generally triangular shaped cross-section and a longitudinal axis generally parallel to the longitudinal axis of the frame, the rod box being pivotally connected to the frame and being movable between a stowed position and an operational position, wherein, when in the operational position, the drill rods can be loaded into the rod box and removed from the rod box during a drilling operation, and wherein, when in the operational position, the furthest portion of the rod box from the vertical reference plane is located at a distance D1 therefrom, and wherein when in the stowed position the furthest portion of the rod box from the vertical reference plane is located at a distance D2 therefrom, wherein the distance D1 is greater than the distance D2.

13. The horizontal directional drilling machine of claim 12, wherein the horizontal directional drilling machine has a width less than or equal to 42 inches when the rod box is in the stowed position.

14. The horizontal directional drilling machine of claim 13, wherein the horizontal directional drilling machine has a width less than or equal to 36 inches when the rod box is in the stowed position.

15. The horizontal directional drilling machine of claim 12, wherein the frame includes a positive stop that interacts with the rod box to prevent rotation of the rod box past the operational and stowed positions.

16. The horizontal directional drilling machine of claim 12, wherein the rod box includes a lever for moving the rod box between the stowed position and the operational position.

17. The horizontal directional drilling machine of claim 16, wherein the lever is slidably attached to the rod box and movable within a channel member associated with the rod box, and wherein the lever interfaces with the frame so as to lock the rod box in either the operational position or the stowed position.

18. The horizontal directional drilling machine of claim 12, wherein the rod box is lockable and prevented from moving either in the stowed position or in the operational position.

* * * * *